US007749063B2

(12) United States Patent
Belger et al.

(10) Patent No.: US 7,749,063 B2
(45) Date of Patent: Jul. 6, 2010

(54) GAMING DEVICE HAVING FREE SPIN MODE WITH SYMBOL ELIMINATION

(75) Inventors: Matthew E. Belger, N. Las Vegas, NV (US); Karen M. Cregan, Reno, NV (US)

(73) Assignee: IGT, Reno, NV (US)

( * ) Notice: Subject to any disclaimer, the term of this patent is extended or adjusted under 35 U.S.C. 154(b) by 1430 days.

(21) Appl. No.: 10/953,818

(22) Filed: Sep. 29, 2004

(65) Prior Publication Data

US 2006/0084494 A1 Apr. 20, 2006

(51) Int. Cl.
*A63F 9/24* (2006.01)

(52) U.S. Cl. ..... 463/16; 463/19; 463/20

(58) Field of Classification Search ..... 463/9, 463/16–22, 25
See application file for complete search history.

(56) References Cited

U.S. PATENT DOCUMENTS

| | | | | |
|---|---|---|---|---|
| 4,624,459 | A | 11/1986 | Kaufman | |
| 4,695,053 | A | 9/1987 | Vazquez, Jr. et al. | |
| 4,991,848 | A | 2/1991 | Greenwood et al. | |
| 5,209,479 | A | 5/1993 | Nagao et al. | |
| 5,342,047 | A | 8/1994 | Heidel et al. | |
| 5,393,057 | A | 2/1995 | Marnell, II | |
| 5,393,061 | A * | 2/1995 | Manship et al. | 463/20 |
| 5,407,200 | A | 4/1995 | Zalabak | |
| 5,423,539 | A | 6/1995 | Nagao | |
| 5,449,173 | A | 9/1995 | Thomas et al. | |
| 5,456,465 | A | 10/1995 | Durham | |
| 5,560,603 | A | 10/1996 | Seelig et al. | |
| 5,647,798 | A | 7/1997 | Falciglia | |
| 5,722,891 | A | 3/1998 | Inoue | |
| 5,732,948 | A | 3/1998 | Yoseloff | |
| 5,772,506 | A | 6/1998 | Marks et al. | |
| 5,775,692 | A | 7/1998 | Watts et al. | |

(Continued)

FOREIGN PATENT DOCUMENTS

AU 199716432 B2 9/1997

(Continued)

OTHER PUBLICATIONS

3-Way Action Poker Brochure and Article written by IGT, published in 2002.

(Continued)

*Primary Examiner*—Peter DungBa Vo
*Assistant Examiner*—Omkar Deodhar
(74) *Attorney, Agent, or Firm*—K&L Gates, LLP

(57) ABSTRACT

A bonus game that operates in combination with a slot machine base game is provided. The bonus game includes a series of free spins or free evaluations in which symbols of a set of symbols are generated. The free spins also generate executor symbols that alone or in accumulation cause one of the symbols of the set to be eliminated or replaced. In either case the symbols remaining in the set have a higher probability of being generated and a higher probability exists that a larger award paying combination of the remaining symbols will be generated. The elimination sequence can be repeated a number of times further increasing the probability of generating a higher paying award for the player. The present invention is operable with different types of base games such as slot and poker.

38 Claims, 16 Drawing Sheets

U.S. PATENT DOCUMENTS 5,823,874 A 10/1998 Adams
5,833,537 A * 11/1998 Barrie ..... 463/21
5,848,932 A 12/1998 Adams
5,855,514 A 1/1999 Kamille
5,882,261 A 3/1999 Adams
5,918,880 A 7/1999 Voigt, IV et al.
5,919,088 A 7/1999 Weiss
5,935,002 A 8/1999 Falciglia
5,964,463 A 10/1999 Moore, Jr.
5,971,849 A * 10/1999 Falciglia ..... 463/16
5,980,384 A 11/1999 Barrie
5,988,638 A 11/1999 Rodesch et al.
5,997,401 A 12/1999 Crawford
6,003,867 A 12/1999 Rodesch et al.
6,004,207 A * 12/1999 Wilson et al. ..... 463/20
6,012,982 A 1/2000 Piechowiak et al.
6,015,346 A 1/2000 Bennett
6,059,289 A 5/2000 Vancura
6,089,976 A 7/2000 Schneider et al.
6,089,977 A 7/2000 Bennett
6,089,978 A 7/2000 Adams
6,102,400 A 8/2000 Scott et al.
6,102,798 A * 8/2000 Bennett ..... 463/16
6,117,009 A 9/2000 Yaseloff
6,120,031 A 9/2000 Adams
6,126,542 A 10/2000 Fier
6,135,885 A 10/2000 Lermusiaux
6,142,873 A 11/2000 Weiss et al.
6,149,521 A 11/2000 Sanduski
6,159,097 A * 12/2000 Gura ..... 463/20
6,159,098 A 12/2000 Slomiany et al.
6,173,955 B1 * 1/2001 Perrie et al. ..... 273/146
6,174,233 B1 1/2001 Sunaga et al.
6,174,235 B1 1/2001 Walker et al.
6,186,894 B1 2/2001 Mayeroff
6,190,254 B1 2/2001 Bennett
6,190,255 B1 2/2001 Thomas et al.
6,203,429 B1 3/2001 Demar et al.
6,220,959 B1 4/2001 Holmes, Jr. et al.
6,224,482 B1 5/2001 Bennett
6,224,483 B1 5/2001 Mayeroff
6,231,442 B1 5/2001 Mayeroff
6,234,897 B1 5/2001 Frohm et al.
6,238,288 B1 5/2001 Walker et al.
6,251,013 B1 6/2001 Bennett
6,261,177 B1 7/2001 Bennett
6,270,409 B1 8/2001 Shuster
6,270,411 B1 8/2001 Gura et al.
6,305,686 B1 10/2001 Perrie et al.
6,309,299 B1 10/2001 Weiss
6,309,300 B1 10/2001 Glavich
6,311,976 B1 11/2001 Yoseloff et al.
6,312,334 B1 11/2001 Yoseloff
6,315,660 B1 11/2001 DeMar et al.
6,315,663 B1 11/2001 Sakamoto
6,315,664 B1 11/2001 Baerlocher et al.
6,319,124 B1 11/2001 Baerlocher et al.
6,322,309 B1 11/2001 Thomas et al.
6,328,649 B1 12/2001 Randall et al.
6,334,814 B1 1/2002 Adams
6,336,863 B1 1/2002 Baerlocher et al.
6,340,158 B2 1/2002 Pierce et al.
6,346,043 B1 2/2002 Colin et al.
6,347,996 B1 2/2002 Gilmore et al.
6,364,767 B1 4/2002 Brossard et al.
6,364,768 B1 4/2002 Acres et al.
6,375,570 B1 4/2002 Poole
6,394,902 B1 5/2002 Glavich et al.
6,398,218 B1 6/2002 Vancura
6,398,644 B1 6/2002 Perrie et al.
6,406,369 B1 6/2002 Baerlocher et al.
6,413,160 B1 7/2002 Vancura
6,413,161 B1 7/2002 Baerlocher et al.
6,416,408 B2 7/2002 Tracy et al.
6,419,579 B1 7/2002 Bennett
6,435,511 B1 8/2002 Vancura et al.
6,439,993 B1 8/2002 O'Halloran
6,443,452 B1 9/2002 Brune
6,454,651 B1 9/2002 Yoseloff
6,471,208 B2 10/2002 Yoseloff et al.
6,481,713 B2 11/2002 Perrie et al.
6,491,584 B2 12/2002 Graham et al.
6,494,454 B2 12/2002 Adams
6,506,118 B1 1/2003 Baerlocher et al.
6,514,141 B1 2/2003 Kaminkow et al.
6,537,150 B1 3/2003 Luciano et al.
6,537,152 B2 3/2003 Seelig et al.
6,561,904 B2 5/2003 Locke et al.
6,565,436 B1 5/2003 Baerlocher
6,585,591 B1 * 7/2003 Baerlocher et al. ..... 463/25
6,602,137 B2 8/2003 Kaminkow et al.
6,604,740 B1 8/2003 Singer et al.
6,612,575 B1 9/2003 Cole et al.
6,712,694 B1 3/2004 Nordman
6,719,630 B1 4/2004 Seelig et al.
6,733,386 B2 5/2004 Cuddy et al.
6,733,389 B2 5/2004 Webb et al.
6,805,349 B2 10/2004 Baerlocher et al.
6,869,360 B2 3/2005 Marks et al.
6,905,406 B2 6/2005 Kaminkow et al.
6,910,962 B2 * 6/2005 Marks et al. ..... 463/16
6,913,532 B2 7/2005 Baerlocher et al.
6,921,335 B2 7/2005 Rodgers et al.
6,955,600 B2 10/2005 Glavich et al.
2001/0009865 A1 7/2001 Demar et al.
2002/0010017 A1 1/2002 Bennett
2003/0054875 A1 3/2003 Marks et al.
2003/0060272 A1 3/2003 Glavich et al.
2003/0073482 A1 4/2003 Baerlocher et al.
2003/0073483 A1 4/2003 Glavich et al.
2003/0162585 A1 8/2003 Bigelow et al.
2003/0203753 A1 10/2003 Muir et al.
2004/0002372 A1 1/2004 Rodgers et al.
2004/0038731 A1 2/2004 Englman
2004/0048652 A1 * 3/2004 Ching et al. ..... 463/20
2004/0053666 A1 3/2004 Vancura
2004/0053669 A1 * 3/2004 Gerrard et al. ..... 463/20
2004/0053672 A1 3/2004 Baerlocher
2004/0072612 A1 4/2004 Rodgers et al.
2004/0137982 A1 7/2004 Cuddy et al.
2004/0147306 A1 7/2004 Randall et al.
2004/0266516 A1 12/2004 Thomas
2004/0266517 A1 12/2004 Bleich et al.
2005/0049035 A1 3/2005 Baerlocher et al.
2005/0070354 A1 3/2005 Baerlocher et al.
2005/0233801 A1 10/2005 Baerlocher et al.
2005/0266917 A1 12/2005 Glavich et al.

FOREIGN PATENT DOCUMENTS

AU A-50327/96 10/1997
AU B-43613/97 2/1998
AU A-199747657 B2 6/1998
AU A-63553/98 10/1998
AU 199917318 A1 9/1999
EP 0688002 A1 12/1995
EP 0798676 A1 10/1997
EP 0874337 A1 10/1998
EP 0926645 A2 6/1999
EP 0944030 A2 9/1999
EP 0 981 119 A2 2/2000
EP 0984409 A2 3/2000
EP 0945837 A2 9/2000
EP 1 513 117 A2 3/2005

| | | | |
|---|---|---|---|
| GB | 2 322 217 | A | 8/1998 |
| GB | 2328311 | A | 2/1999 |
| WO | WO 97/32285 | | 9/1997 |
| WO | WO 0012186 | | 3/2000 |
| WO | WO 00/32286 | | 6/2000 |
| WO | WO 01/26019 | | 4/2001 |
| WO | WO 2004/025584 | A2 | 3/2004 |
| WO | WO 2005/028043 | A2 | 9/2004 |

OTHER PUBLICATIONS

Addams Family Advertisement and Article written by Strictly Slots, published Jul. 2000.
American Thunder Screen Shots written by IGT, published in 1998.
Bally Slot Machines Electro-Mechanicals 1964-1980 Book [In Part], Revised 3rd Edition written by Marshall Fey.
Bonus Times Article written by Strictly Slots, published Jul. 2000.
Break the Spell Advertisement written by Atronic Casino Technology, Ltd., published in 1999, on or before December thereof.
Break the Spell Article written by Strictly Slots/Atronic Casino Technology, Ltd., published in Sep. 2000.
Break the Spell Atronic Web Page, published in Jan. 2001.
Cash Crop Brochure written by Aristocrat Leisure Industries, published in 1997.
Castaways Article written by Strictly Slots, published in Dec. 2000.
Cuckoo Aristocrat Brochure written by Aristocrat, published in Feb. 1998.
DoubleBucks Brochure written by IGT (not dated).
Enchanted Forest™ Gaming Description from Aristocrat, available in 1994, on or before December thereof.
Enchanted Unicorn Advertisement written by IGT, published in 2001, on or before December thereof.
Field Testing New Slots Article written by Strictly Slots, published in Jul. 2000.
Good Times Advertisement written by International Game Technology, published in 1999.
Jazzy Jackpots Article written by Strictly Slots, published in Mar. 2001.
Jewel in the Crown Advertisements written by Barcrest Ltd., published 1999.
Leopard Spots™ (website) written by www.igt.com, printed Mar. 21, 2001.
Mega Multiplier® (website) written by www.wmsgaming.com, printed May 22, 2001.
Money Grab (website) written by www.wmsgaming.com, printed May 22, 2001.
Money Mouse Brochure written by Aristocrat Leisure Industries, published in 1997.
Polly & Roger Brochure written by VLC, Inc, published in 2000.
Super Cherry Advertisement written by International Game Technology, published in 2001.
Take Your Pick Article written by Strictly Slots, published Mar. 2001.
Top Cat Brochure written by WMS Gaming, Inc., published date not known.
Treasure Tunnel, Treasure Wheel Brochure written by Sigma Game, Inc., published date unknown.
Typhoon Lagoon written by Strictly Slots, published in Apr. 2002.
Wild Streak Advertisement written by WMS Gaming, Inc., published in 2001, on or before December thereof.
X Factor Brochure and Website Page written by WMS Gaming, Inc., published in 1998.
Yahtzee Video Game Advertisement, written by Mikohn Winning Solutions Worldwide, published 1999.
Catch A Wave Advertisement written by IGT, published in Dec. 2000.
Dolphin Treasure Advertisement written by Aristocrat Leisure Industries Pty., Ltd., published in 1996.
Spin Til You Win Game Description written by IGT, published in 1996.
Wild Bear Salmon Run Advertisement written by IGT, published in 2003.

* cited by examiner

FIG. 4

16,18

Payable for free spin sequence and explanation of free spin sequence

| | |
|---|---|
| Paying Symbols<br>A,B,C,D,F,&G | Pays<br>5 of of the same A,B,C,D,F or G on active (from left) (scatter) payline pays 200 credits<br><br>4 of of the same A,B,C,D,F or G on active (from left) (scatter) payline pays 30 credits<br><br>3 of of the same A,B,C,D,F or G on active (from left) (scatter) payline pays 5 credits<br><br>2 of of the same A,B,C,D,F or G on active (from left) (scatter) payline pays 2 credits |
| W Wild Symbols<br>- Represents any of the symbols A,B,C D,F&G | |
| EX Execution Symbol<br>- Increments meter for each appearance on an active (scatter) payline | Elimination #1 - Accumulate three EX symbols to eliminate a remaining one of A,B,C,D,F&G from free spin set<br><br>Elimination #2/#3 - Accumulate three EX symbols to replace a remaining one of A,B,C,D,F&G with a W symbol (remaining symbol) in the free spin set |

FIG. 5

16,18

Payable for base poker game & free deal sequence and explanation of the deal sequence In both base game and free deal sequence pays are as follows:

| | |
|---|---|
| Royal Flush | 300 |
| 5 of a kind | 100 |
| Straight Flush | 50 |
| 4 of kind | 25 |
| Flush | 15 |
| Full House | 10 |
| 3 of a kind | 6 |
| Straight | 4 |
| 2 Pairs | 3 |
| Jack or Better | 2 |

(T) - Symbol with Jack or Better Triggers Free Deal Sequence

During the free deal sequence, (JW) Joker's wild cards activated. Joker represents each remaining face card in deck.

Elimination #1 - Accumulate three Aces to eliminate a remaining card denomination from the deck.

Elimination #2 - Accumulate three Aces to replace a remaining card denomination from the deck with the Joker's wild card.

Elimination #3 - Accumulate three Aces to replace a remaining card denomination with another card denomination.

GAMING DEVICE HAVING FREE SPIN MODE WITH SYMBOL ELIMINATION

CROSS REFERENCES TO RELATED APPLICATIONS

This application relates to the following commonly owned applications: "GAMING DEVICE HAVING A RE-TRIGGER SYMBOL BONUS SCHEME," Ser. No. 09/981,133, now U.S. Pat. No. 6,913,532; "GAMING DEVICE HAVING REGENERATING MULTIPLE AWARD OPPORTUNITIES," Ser. No. 09/960,784, now U.S. Pat. No. 7,066,814; "GAMING DEVICE HAVING FREE GAMES BONUS WITH A CHANGING MULTIPLIER," Ser. No. 10/086,146, now U.S. Pat. No. 7,258,611; 'GAMING DEVICE HAVING A BONUS GAME WITH MULTIPLE PLAYER SELECTABLE AWARD OPPORTUNITIES," Ser. No. 10/237,207, "GAMING DEVICE HAVING A RE-TRIGGERING SYMBOL BONUS SCHEME WITH A BONUS SYMBOL ACCUMULATOR," Ser. No. 10/071,441, now U.S. Pat. No. 6,955,600; "GAMING DEVICE INCLUDING A GAME HAVING PLAYER SELECTED FUNCTION BASED ON SYMBOLS IN A FREE SPINS GAME," Ser. No. 10/243,052, now U.S. Pat. No. 7,121,942; "GAMING DEVICE HAVING A PROBABILITY ENHANCING TRIGGER SYMBOL," Ser. No. 10/241,255, now U.S. Pat. No. 7,056,213; "GAMING DEVICE INCLUDING A GAME HAVING A WILD SYMBOL RELATED AWARD," Ser. No. 10/633,391, now U.S. Pat. No. 7,090,580; "GAMING DEVICE HAVING A PROBABILITY-ENHANCING TRIGGER SYMBOL," Ser. No. 10/661,443, now U.S. Pat. No. 7,074,127; "GAMING DEVICE HAVING A BONUS GAME WITH MULTIPLE PLAYER SELECTABLE AWARD OPPORTUNITIES," Ser. No. 10/660,076, now U.S. Pat. No. 7,235,011; "GAMING DEVICE HAVING SEQUENTIAL ACTIVATIONS OF A GAME AND REPLAY OF PREVIOUS ACTIVATIONS OF THE GAME," Ser. No. 10/956,508, now U.S. Pat. No. 7,322,887; "GAMING DEVICE WITH CHANGING WILD SYMBOLS," Ser. No. 10/956,303, now U.S. Pat. No. 7,513,826; "GAMING DEVICE HAVING A FREE SPIN GAME," Ser. No. 10/953,812, now U.S. Pat. No. 7,094,148 "GAMING DEVICE HAVING A RE-TRIGGERING SYMBOL BONUS SCHEME WITH A BONUS SYMBOL ACCUMULATOR AND PLAYER SELECTION OF ACCUMULATION TOTAL," Ser. No. 10/952,656, now U.S. Pat. No. 7,473,147; and "GAMING DEVICE HAVING A RE-TRIGGER SYMBOL BONUS SCHEME," Ser. No. 11/156,112, now U.S. Pat. No. 7,331,867.

BACKGROUND OF THE INVENTION

Gaming device manufactures have long provided gaming machines employing a plurality of reels, wherein the reels each have a plurality of symbols. In the 1930's, gaming device manufacturers provided a three reel gaming device, wherein each reel had ten stops, which produced a thousand combinations. One way for the manufacturers to increase the number of combinations was to increase the size of the reel and to add more stops. During the next four decades, the reels in the gaming devices increased to twenty stops. In the 1970's, manufacturers developed a twenty-two stop reel machine, in the early 80's a twenty-five stop reel machine, and in 1985, International Game Technology, the assignee of the present invention, developed a thirty-two stop reel machine. This machine had 32,768 possible combinations.

Another way manufacturers increased the number of combinations was to add reels. In 1955, a manufacturer produced a four-reel slot machine, which increased the number of combinations on a twenty stop machine to 160,000. In the middle 1970's, a manufacturer produced the first five-reel slot machine, which had twenty-two stop reels and produced combinations in excess of five million.

The next advancement in the effort to produce more payout combinations was the video or CRT screen slot machine, wherein the reels were simulated as opposed to mechanical. Video slot machines do not have mechanical drums or reels which rotate, do not need to precisely stop the same at certain positions and are therefore not limited by a maximum allowable drum radius. Each reel can have a virtuality unlimited number of stops. Initially, the Nevada gaming Commission limited the stops on the video machines (e.g., eighty-four stops on a three reel machine) but has since removed the limit. In 1989, a particular video reel machine employed reels having hundreds of stops and more than millions of combinations.

The total number of combinations affects the percentage of time that a player will obtain a particular winning combination as well as the overall payout percentage of the machine. For example, a three reel machine having twenty-two stops per reel, where the first reel has two oranges, the second reel has three oranges, and the third reel has seven oranges will yield an orange, orange and orange combination 42 times in every 10,648 plays (22×22×22) or 0.39% of the time. If the orange, orange, orange combination pays 20 coins, then the total coins paid is 20×42 or 840 coins in every 10,648 plays. Adding the total coins paid for each winning combination and dividing that number by 10,648 yields the machine's total payout percentage.

In the known gaming systems the percentage of obtaining a winning combination is set. In certain known progressive gaming machines, the payout of a grand prize grows each time a player plays the machine. The increasing payout increases the total coins paid as shown above, which in turn increases the overall payout percentage. Nevertheless, the percentage of times that a player will receive one of the combinations remains constant.

Free spins have also been provided in slot games. Upon winning free spins, the reels can auto-generate a number of outcomes and provide the player credits from winning symbol combinations occurring in the outcomes. Free spins provide an avenue for adding fun and excitement to standard gaming, while maintaining consistency with the slot base game and enabling the slot game to be played and displayed on simulated or electromechanical reels.

To increase player enjoyment and excitement, it is desirable to provide players with new types of gaming devices that attract the player and keep the player entertained.

SUMMARY OF THE INVENTION

The present invention provides a gaming machine including a base game operable upon a wager and a bonus game that operates in combination with the wagering base game. The bonus game or mode includes a series of free activations such as free spins or free deals in which a symbol or card can be eliminated from a set of symbols. The player plays the base game until triggering a free spin sequence for slot games or a free deal sequence for card games such as poker according to the base game. In the free spin or deal sequence or mode, the gaming device generates sets of symbols, which can be the same or different as the symbols used in the base game. The gaming device can also generate wild symbols in the free spin or deal sequence or mode.

In the free spin or free deal sequence or mode, the gaming device symbols also includes one or more executor symbols. The executor symbols are randomly generated in one embodiment. In one embodiment, the executor symbols cause a meter to increment. When the meter increments to a designated or particular point or level, the gaming device eliminates or removes a symbol from the set of symbols or a card from the deck of cards subsequently used in the free spin deal sequence (i.e., in one, a plurality, or all of the subsequent free spins or activations). In other words, the gaming device will not generate that eliminated or removed symbol or card again in the free spin mode (i.e., in one, a plurality, or all of the subsequent free spins or activations). Thus, the gaming device can prevent the eliminated symbol from subsequently be generated in a free spin. In one embodiment, the eliminated symbol is not actually eliminated from the set or removed from the reels; but, rather the processor of the gaming machine prevents that symbol from being generated in one or more subsequent free spins. In one embodiment, if the eliminated symbol is initially selected to be generated, the processor can cause a generation of another remaining symbol (such as by re-spinning a reel to generate another symbol on the reel). The removal of the symbol or card increases the likelihood of the player achieving multiple combinations of the other symbols such as a same symbol or card in subsequent free spins, free deals, or free activations of the remaining symbols or cards. That is, the removal of a symbol or card increases the likelihood of generating each of the remaining symbols or cards. Accordingly, a free spin or free deal game is provided that over time becomes on average more lucrative on average for the player.

The free spin or free deal sequence includes multiple embodiments. In one embodiment, the symbol or card is merely removed from the free spin, free deal or free activation set of symbols, lessening the total number of different symbols that can be generated. In an alternative embodiment, the symbol is replaced by another symbol. The symbol is replaced either with a wild symbol or one of the remaining other symbols or cards of the set or deck, respectively. In one such embodiment, each occurrence of the symbol to be removed in the set is transformed or replaced by a wild symbol. In these two alternative embodiments, the total number of symbols that can be generated does not change; however, the total number of different symbols does change. In the alternative embodiments, the likelihood of generating a combination or multiple ones of any one of the remaining symbols increases.

The free spin or free deal sequence in one embodiment continues to generate outcomes until a number of provided free spins or free deals is exhausted. The number provided can be dependent upon one or more different factors, such as the factors described below. In one embodiment, for example, the player receives more free spins or free deals by generating more triggering symbols in the base game. In another embodiment, the number of free spins is based at least in part on the player's wager in the primary game which triggers the free activation mode.

During the series of free spins or free deals, the symbol elimination or replacement meter can be incremented to its final position multiple times, thereby eliminating or replacing multiple symbols throughout the course of the free generation sequence. Accordingly, the game over time on average becomes more favorable to the player as larger combinations of paying symbol combinations are more likely to occur.

After the free spin sequences of the present invention are provided, credits obtained from the free spins are paid to the player during a credit roll-up. The player can then resume playing the base game.

It is therefore an advantage of the present invention to provide a fun and exciting slot machine or poker bonus game.

A further advantage of the present invention is to provide an improved free spin game.

Yet another advantage of the present invention is to provide a free generation game adaptable to multiple types of gaming devices such as slot and poker.

Moreover, it is an advantage of the present invention to provide a bonus game that uses base game symbols or cards in a fun and exciting way to provide a bonus game that is different yet related to the base game.

Additional features and advantages of the present invention are described in, and will be apparent from, the following Detailed Description of the Invention and the figures.

BRIEF DESCRIPTION OF THE FIGURES

FIG. 4 is an elevation view of one of the display devices of the gaming machine showing one example of a free spin sequence paytable and explanation screen of the present invention.

FIG. 5 is an elevation view of one of the display devices of the gaming machine showing one example of a paytable used in connection with the free deal game of the present invention.

DETAILED DESCRIPTION OF THE INVENTION

The Gaming Device Generally

Figure 1A:
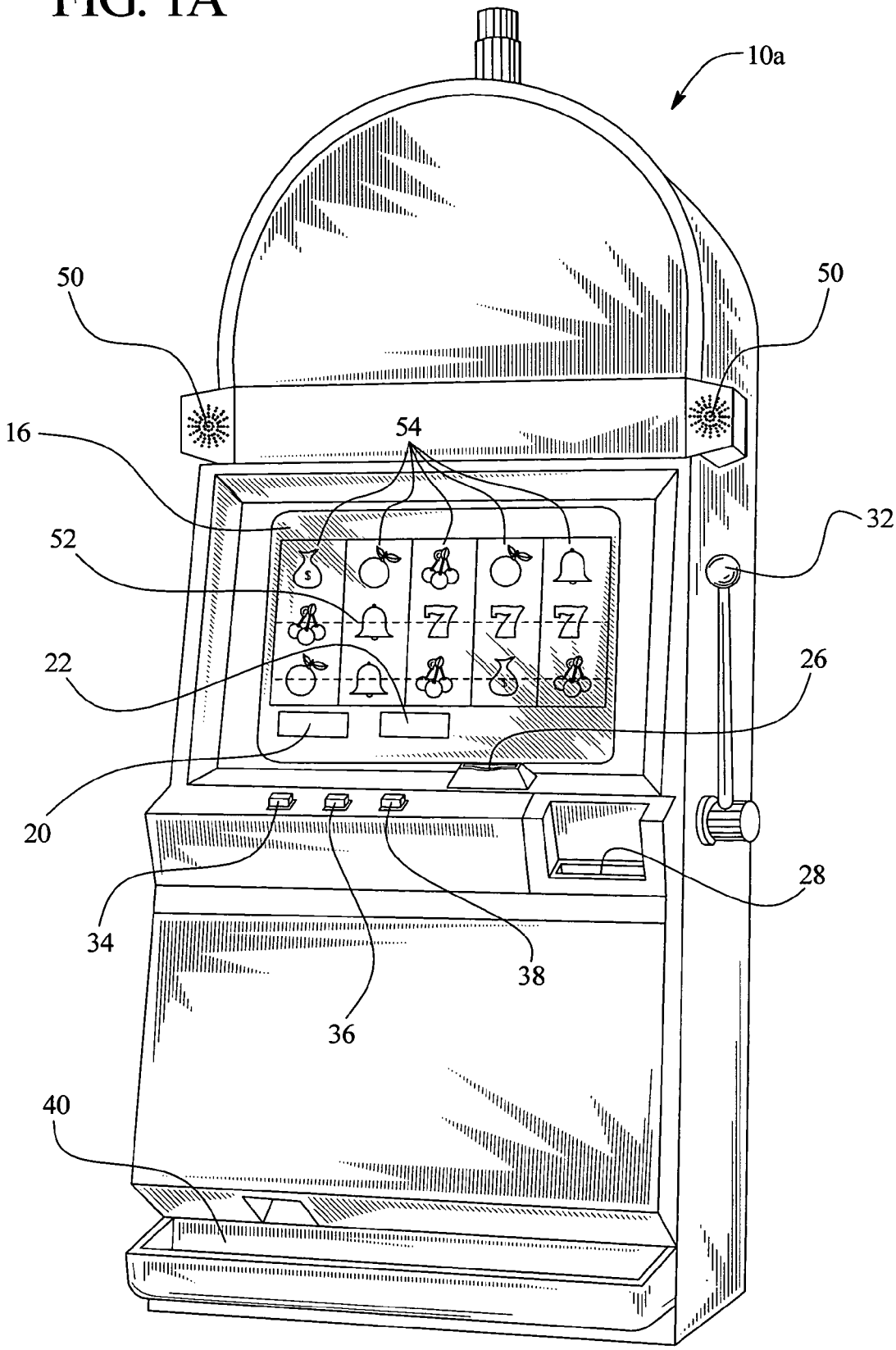
FIG. 1A is a front perspective view of one embodiment of the gaming device of the present invention.
Figure 1B:
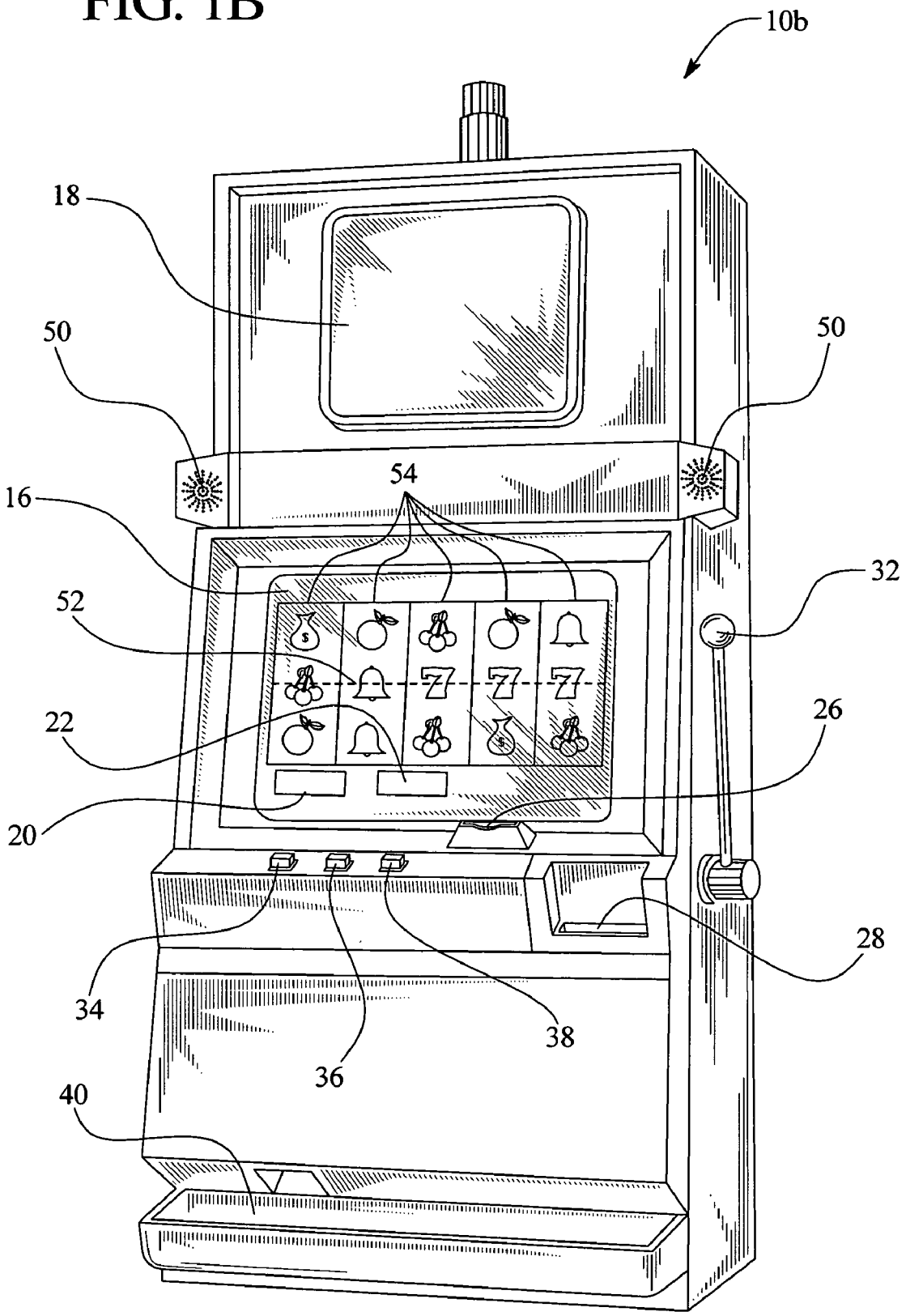
FIG. 1B is a front perspective view of another embodiment of the gaming device of the present invention.

Referring now to the drawings, two alternative embodiments of the gaming device of the present invention are illustrated in FIGS. 1A and 1B as gaming device 10*a* and gaming device 10*b*, respectively. Gaming device 10*a* and/or gaming device 10*b* are generally referred to herein as gaming device 10.

In one embodiment, as illustrated in FIGS. 1A and 1B, gaming device 10 has a support structure, housing or cabinet which provides support for a plurality of displays, inputs, controls and other features of a conventional gaming machine. Gaming device 10 is configured to be operated by a player standing or sitting. The gaming device may be positioned on a base or stand or is configured as a pub-style table-top game (not shown) which a player can operate while sitting. As illustrated by the different configurations shown in FIGS. 1A and 1B, gaming device 10 can be constructed with varying cabinet and display configurations.

Figure 2A:
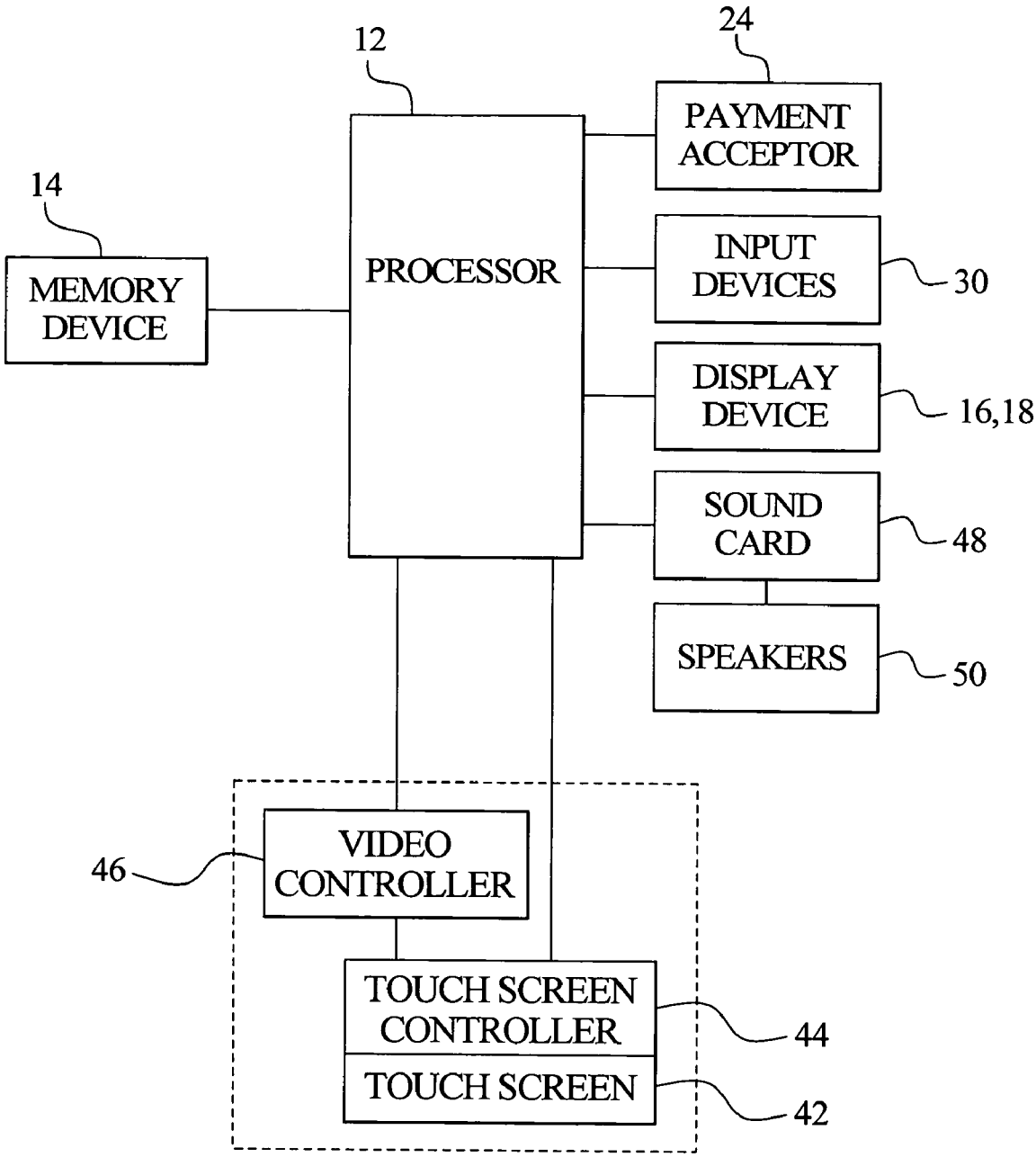
FIG. 2A is a schematic block diagram of one embodiment of an electronic configuration for one of the gaming devices of the present invention.

In one embodiment, as illustrated in FIG. 2A, gaming device 10 includes at least one processor 12, such as a microprocessor, a microcontroller-based platform, a suitable integrated circuit or one or more application-specific integrated circuits (ASIC's). Processor 12 is in communication with or operable to access or to exchange signals with at least one data storage or memory device 14. In one embodiment, processor 12 and memory device 14 reside within the cabinet of gaming device 10. The memory device stores program code and instructions, executable by processor 12, to control gaming device 10. Memory device 14 also stores other data such as image data, event data, player input data, random or pseudo-random number generators, pay-table data or other operating data, information and applicable game rules that relate to the play of gaming device 10.

Memory device 14 includes random access memory (RAM) and read only memory (ROM) in one preferred embodiment. Alternatively or additionally, memory device 14 includes flash memory and/or EEPROM (electrically erasable programmable read only memory). Any other suitable magnetic, optical and/or semiconductor memory may be implemented in conjunction with gaming device 10 of the present invention. Processor 12 and memory device 14 may be collectively referred to herein as a "computer" or "controller."

In one embodiment, part or all of the program code and/or operating data described above can be stored in a detachable or removable memory device, including, but not limited to, a suitable cartridge, disk or CD ROM. A player can use such a removable memory device in a desktop, a laptop personal computer, a personal digital assistant (PDA) or other computerized platform.

In one embodiment, as discussed in more detail below, gaming device 10 randomly generates awards and/or other game outcomes based on probability data. That is, each award or other game outcome is associated with a probability and gaming device 10 generates the award or other game outcome to be provided to the player based on the associated probabilities. In this embodiment, since gaming device 10 generates outcomes randomly or based upon a probability calculation, there is no certainty that gaming device 10 will provide the player with any specific award or other game outcome.

In another embodiment, as discussed in more detail below, gaming device 10 employs a predetermined or finite set or pool of awards or other game outcomes. In this embodiment, as each award or other game outcome is provided to the player, gaming device 10 removes the provided award or other game outcome from the predetermined set or pool. Once removed from the set or pool, the specific provided award or other game outcome cannot be provided to the player again. In this type of embodiment, gaming device 10 provides players with all of the available awards or other game outcomes over the course of the play cycle and guarantees a designated amount of actual wins and losses.

In one embodiment, as illustrated in FIG. 2A, processor 12 of gaming device 10 controls one or more display devices. The display devices are connected to or mounted to the cabinet of gaming device 10. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated with the primary game and/or information relating to the primary or secondary game.

The display devices may include, without limitation, a monitor, a television display, a plasma display, a liquid crystal display (LCD), a display based on light emitting diodes (LED) or any other suitable electronic device or display mechanism. In one embodiment, as described in more detail below, the display device includes a touchscreen with an associated touchscreen controller. The display devices may be of any suitable configuration, such as a square, a rectangle or an elongated rectangle.

The display devices of gaming device 10 are configured to display at one or a plurality of games or other suitable images, symbols and indicia such as any visual representation or exhibition of the movement of objects such as mechanical, virtual or video reels and wheels, dynamic lighting, video images and images of people, characters, places, things and faces of cards, tournament advertisements, promotions and the like.

In one alternative embodiment, the symbols, images and indicia displayed on or by the display device may be in mechanical or electromechanical form. That is, the display device may include any suitable electromechanical device which moves one or more mechanical objects, such as one or more mechanical rotatable wheels or reels that each display at least one image, symbol or indicia.

As seen in FIGS. 1A and 1B, in one embodiment gaming device 10 includes a credit display 20 which displays a player's current number of credits, cash, account balance or the equivalent. In one embodiment, gaming device 10 includes a bet display 22 which displays a player's amount wagered.

As illustrated in FIG. 2A, in one embodiment, gaming device 10 includes at least one payment acceptor 24 in communication with processor 12. As seen in FIGS. 1A and 1B, the payment acceptor may include a coin slot 26 and a payment, note or bill acceptor 28, where the player inserts money, coins or tokens. The player can place coins in the coin slot or paper money, ticket or voucher into the payment, note or bill acceptor. In other embodiments, devices such as readers or validators for credit cards, debit cards, data cards or credit slips could be used for accepting payment.

In one embodiment, a player may insert an identification card into a card reader 60 of gaming device 10. Card reader 60 is operable with a dedicated keypad 62 or a keypad appearing on display device 16, 18, which cooperates with touch screen 42 and touch screen controller 44 to enable the player to enter passwords, process fund requests, cancel fund requests and the like.

The identification card can be a smart card having a programmed microchip or a magnetic strip coded with a player's identification, credit totals and other relevant information. In one embodiment, money may be transferred to a gaming device through electronic funds transfer. When a player funds gaming device 10, the processor determines the amount of funds entered and the corresponding amount is shown on the credit or other suitable display as described above. Card reader 60 alternatively or additionally accepts payment cards, such as credit cards or debit cards. Card reader 60 in one embodiment includes a magnetic strip reader as is known to those of skill in the art.

As seen in FIGS. 1A, 1B and 2A, in one embodiment gaming device 10 includes at least one input device 30 that communicates with processor 12. Input devices 30 can include any suitable apparatus that enables the player to produce an input signal which is read by the processor. In one embodiment, after appropriate funding of gaming device 10, the input device is a game activation device, such as a pull arm 32 or a play button 34 which is used by the player to start any primary game or sequence of events in gaming device 10. The play button can be any suitable play activator such as a bet one button, a max bet button or a repeat the bet button. In one embodiment, upon appropriate funding, gaming device 10 begins the game play automatically. In another embodiment, upon the player engaging one of the play buttons, gaming device 10 automatically activates game play.

In one embodiment, as shown in FIGS. 1A and 1B, one input device is a bet one button 36. The player places a bet by pushing bet one button 36. The player can increase the bet by one credit each time the player pushes bet one button 36. When the player pushes the bet one button, the number of credits shown in credit display 20 decreases by one, and the number of credits shown in bet display 22 increases by one. In another embodiment, one input device 30 is a bet max button (not shown) that enables the player to bet the maximum wager permitted for a game associated with gaming device 10.

Gaming device 10 also includes a cash out button 38. The player may push cash out button 38 and cash out to receive a cash payment or other suitable form of payment corresponding to the number of remaining credits. In one embodiment, when the player cashes out, the player receives the coins or tokens in a coin payout tray 40. In another embodiment, when the player cashes out, the player receives another type of payout mechanism such as a tickets or credit slip, which are redeemable by a cashier or funded to the player's electronically recordable identification card.

As mentioned above and seen in FIG. 2A, a touchscreen 42 may be provided that couples with a touchscreen controller 44, or some other touch-sensitive display overlay to allow the player to interact with the images on the display. The touchscreen and the touchscreen controller are connected to a video controller 46. A player can make decisions and input signals into gaming device 10 by touching the touchscreen at the appropriate places.

Gaming device 10 may further include a plurality of communication ports for enabling communication of the processor with external peripherals, such as external video sources, expansion buses, game or other displays, an SCSI port or a key pad.

In one embodiment, as seen in FIG. 2A, gaming device 10 includes a sound generating device controlled by one or more sounds cards 48 which function in conjunction with the processor. In one embodiment, the sound generating device operates with at least one speaker 50 or other sound generating hardware and/or software for generating sounds, such as playing music for the primary and/or secondary game or for other modes of gaming device 10, such as an attract mode. Gaming device 10 can provide dynamic sounds coupled with attractive multimedia images displayed on one or more of the display devices to provide an audio-visual representation or to otherwise display full-motion video with sound to attract players to gaming device 10. During idle periods, gaming device 10 may display a sequence of audio and/or visual attraction messages to attract potential players to gaming device 10. The videos may also be customized for or to provide any appropriate information.

In one embodiment, the gaming machine may include a player or other sensor, such as a camera in communication with the processor (and possibly controlled by the processor) that is selectively positioned to acquire an image of a player actively using gaming device 10 and/or the surrounding area of gaming device 10. In one embodiment, the camera may be configured to selectively acquire still or moving (e.g., video) images and may be configured to acquire the images in either an analog, digital or other suitable format. The display device may be configured to display the image acquired by the camera as well as display the visible manifestation of the game in split screen or picture-in-picture fashion. For example, the camera may acquire an image of the player and that image can be incorporated into the primary and/or secondary game as a game image, symbol or indicia.

Gaming device 10 can incorporate any suitable wagering primary or base game. The gaming machine or device of the present invention may include some or all of the features of conventional gaming machines or devices. The primary or base game may comprise any suitable reel-type game, card game, number game or other game of chance susceptible to representation in an electronic or electromechanical form which produces a random outcome based on probability data upon activation of the game from a wager made by the player. That is, different primary wagering games, such as video poker games, video blackjack games, video keno, video bingo or any other suitable primary or base game may be implemented into the present invention. As described below, the present invention operates at least with the base games of slot and poker.

Slot Base Game Generally

In one embodiment, as illustrated in FIGS. 1A and 1B, a base or primary game may be a slot game with one or more paylines 52. The paylines may be horizontal, vertical, circular, diagonal, angled or any combination thereof. In this embodiment, gaming device 10 displays at least one reel 54, such as three to five reels, in either electromechanical form with mechanical rotating reels or in video form with simulated reels and movement thereof. In one embodiment, an electromechanical slot machine includes a plurality of adjacent, rotatable wheels which may be combined and operably coupled with an electronic display of any suitable type. In another embodiment, if the reels are in video form, the plurality of simulated video reels are displayed on one or more of the display devices as described above.

Each reel displays a plurality of indicia such as bells, hearts, fruits, numbers, letters, bars or other images that correspond to a theme associated with gaming device 10. In this embodiment, gaming device 10 awards prizes when the reels of the primary game stop spinning if specified types and/or configurations of indicia or symbols occur on an active pay line or otherwise occur in a winning combination or pattern.

As seen below in FIGS. 6 to 11 display devices 16 or 18 display a plurality of reels 54*a* to 54*e* (collectively reels 54). Reels 54 operate with five paylines 52*a* through 52*e* (collectively paylines 52). In addition to credit display 20, bet display 22 and play button 34, display device 16 or 18 also displays the number of lines played in display 64, as well as the bet per line in display 66. Further, gaming device 10 provides input devices 30*a* and 30*b* that enable the player to change the number of lines wagered and bet per line, respectively. As seen in FIGS. 7 to 14, once the free spin sequence of the present invention is illustrated, display device 16 or 18 also provides a spins remaining meter 68 and a slot symbol or poker card removal meter 70, the function of each of which is described below.

Poker Base Game Generally

Figure 12:
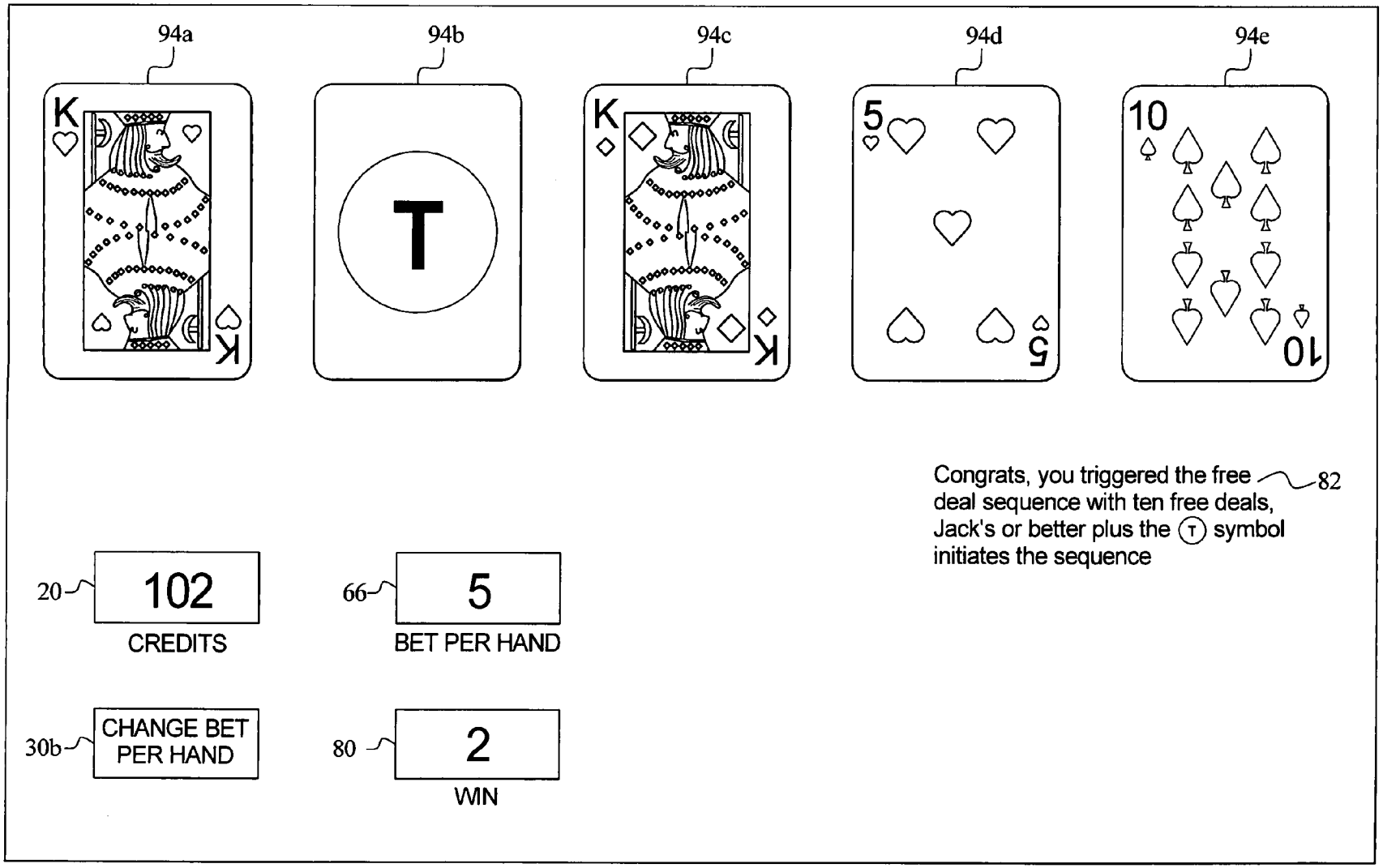
FIGS. 12, 13 and 14 are elevation views of one of the display devices of the gaming machine illustrating one example of a free deal sequence operating with the base game of poker.
Figure 13:
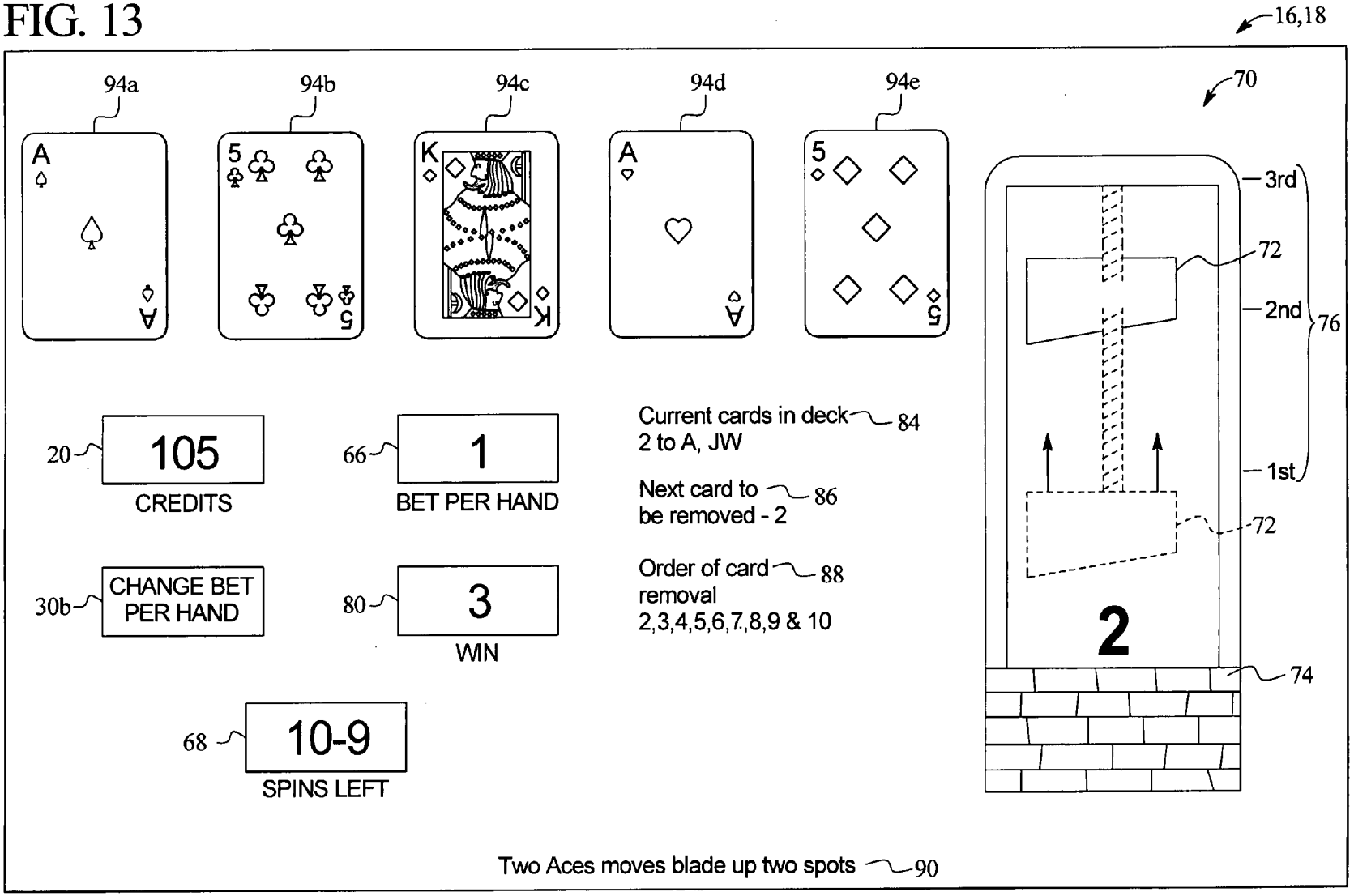
Figure 14:
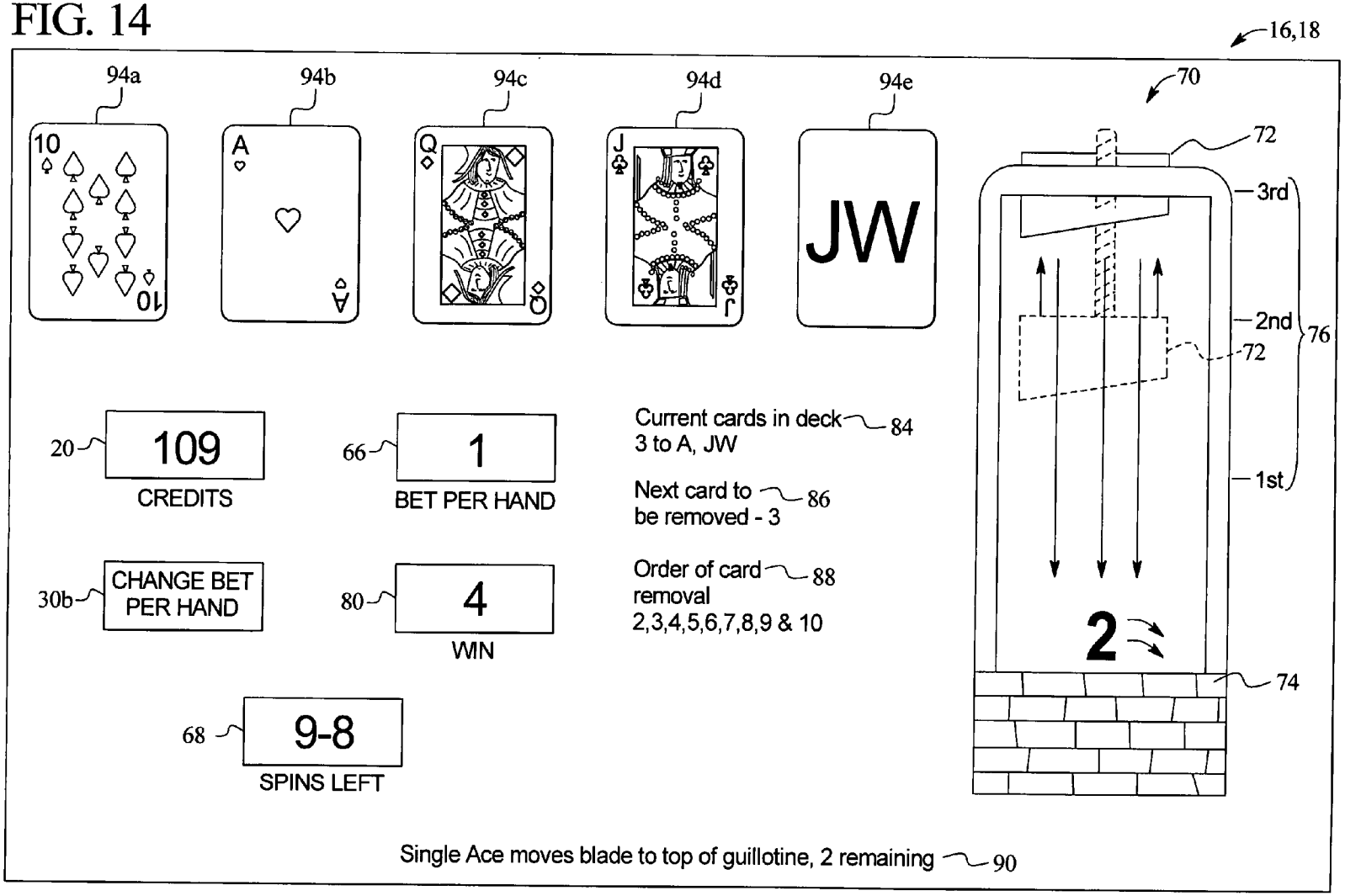

In one embodiment, a base or primary game may be a poker game wherein gaming device 10 enables the player to play a conventional game of video poker and initially deals five cards, all face up, from a virtual deck of fifty-two cards. As seen in FIGS. 12 to 14, playing cards may be dealt to positions

94*a* to 94*c* as in a traditional game of cards or in the case of gaming device 10, the cards may be randomly selected from a predetermined number of cards. If the player wishes to draw, the player selects the cards to hold by using one or more input devices, such as pressing related hold buttons or touching a corresponding area on a touchscreen. After the player presses the deal button, processor 12 of gaming device 10 removes the unwanted or discarded cards from the display and deals replacement cards from the remaining cards in the deck. This results in a final five-card hand. The processor of gaming device 10 compares the final five-card hand to a payout table which utilizes conventional poker hand rankings to determine the winning hands. An award based in an embodiment on the credits wagered is provided to the player upon a winning hand.

In another embodiment, the base or primary game may be a multi-hand version of video poker. In this embodiment, the player is dealt at least two hands of cards. In one such embodiment, the cards in all of the dealt hands are the same cards. In one embodiment each hand of cards is associated with its own deck of cards. The player chooses the cards to hold in a primary hand. The held cards in the primary hand are also held in the other hands of cards. The remaining non-held cards are removed from each displayed hand and replaced with randomly dealt cards. Since the replacement cards are randomly dealt independently for each hand, the replacement cards will usually be different for each hand. The poker hand rankings are then determined hand by hand and awards are provided to the player.

Bonus Game

In one embodiment, in addition to winning credits in a base or primary game, the gaming device may also give players the opportunity to win credits in a bonus or secondary game or bonus or secondary round. The bonus or secondary game enables the player to obtain a bonus prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game.

In one embodiment, gaming device 10 includes a program code that causes processor 12 to automatically begin a bonus round when the player has achieved a triggering event, a qualifying condition or other designated game event in the base or primary game. In another embodiment illustrated below in the paytables of FIGS. 3 and 5, the triggering event or qualifying condition may be a selected outcome in the primary game or a particular arrangement of one or more indicia on a display device in the primary game, such as the number seven appearing on three adjacent reels along a payline 52 in the primary slot game embodiment seen in FIGS. 1A and 1B. In another embodiment, the triggering event or qualifying condition may be triggered by exceeding a certain amount of game play (number of games, number of credits, amount of time), earning a specified number of points during game play or as a random award.

In one embodiment, once a player has qualified for a bonus game, the player may subsequently enhance their bonus game participation by returning to the base or primary game for continued play. Thus, for each bonus qualifying event, such as a bonus symbol, that the player obtains, a given number of bonus game wagering points or credits may be accumulated in a "bonus meter" programmed to accrue the bonus wagering credits or entries towards eventual participation in a bonus game. The occurrence of multiple bonus qualifying events in the primary game may result in an arithmetic or geometric increase in the number of bonus wagering credits awarded. In one embodiment, extra bonus wagering credits may be redeemed during the bonus game to extend play of the bonus game.

In one embodiment, no separate entry fee or buy in for a bonus game need be employed. That is, a player may not purchase an entry into a bonus game. The player must win or earn entry through play of the primary game, thereby encouraging play of the primary game. In another embodiment, qualification of the bonus or secondary game could be accomplished through a simple "buy in" by the player if, for example, the player has been unsuccessful at qualifying for the bonus game through other specified activities.

Server Controlled Gaming Devices

Figure 2B:
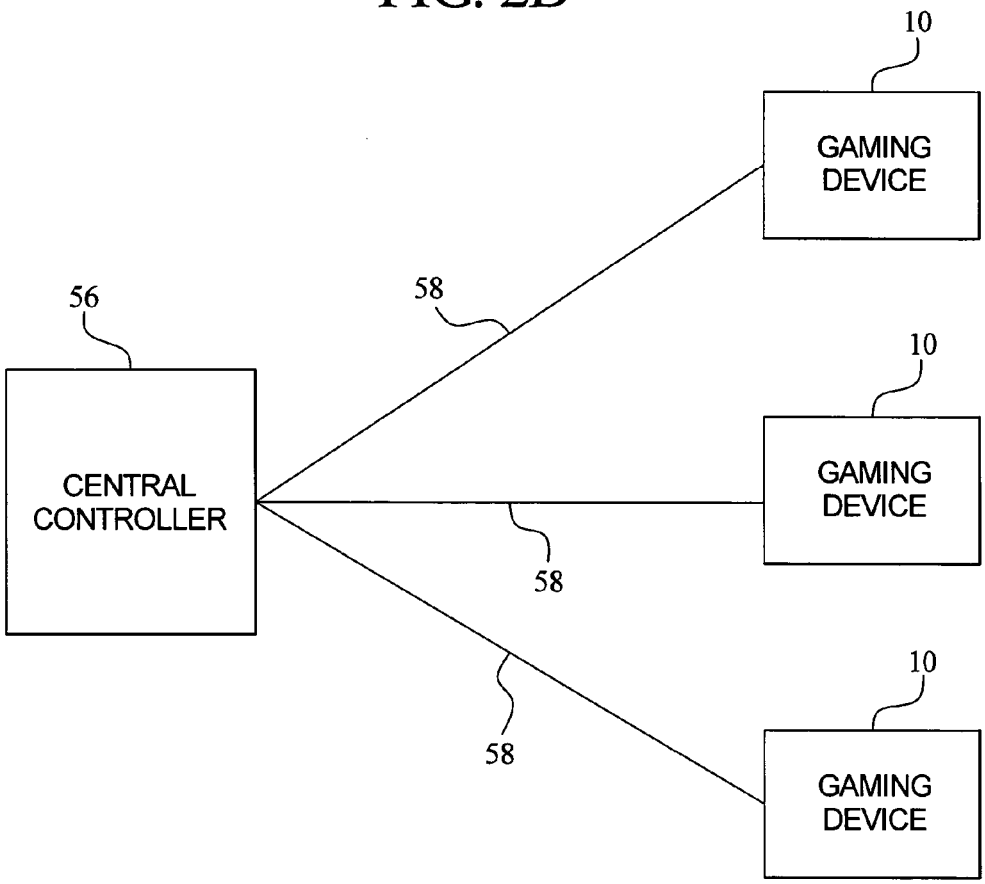
FIG. 2B is a schematic block diagram of one embodiment of a network configuration for a plurality of gaming devices of the present invention.

In one embodiment, as illustrated in FIG. 2B, one or more of the gaming devices 10 of the present invention may be connected to a data network or a remote communication link 58 with some or all of the functions of each gaming device provided at a central location such as a central server or central controller 56. More specifically, processor 12 of each gaming device may be designed to facilitate transmission of signals between the individual gaming device and the central server or controller.

In one embodiment, the game outcome provided to the player is determined by central server or controller 56 and provided to the player at gaming device 10 of the present invention. In this embodiment, each of a plurality of such gaming devices 10 are in communication with the central server or controller 56. Upon a player initiating game play at one of the gaming devices, the initiated gaming device communicates a game outcome request to the central server or controller 56.

In one embodiment, central server or controller 56 receives the game outcome request and randomly generates a game outcome for the primary game based on probability data. In another embodiment, the central server or controller 56 randomly generates a game outcome for the secondary game based on probability data. In a further embodiment, the central server or controller 56 randomly generates a game outcome for both the primary game and the secondary game based on probability data. In this embodiment, the central server or controller 56 is capable of storing and utilizing program code or other data similar to processor 12 and memory device 14 of gaming device 10.

In an alternative embodiment, the central server or controller 56 maintains one or more predetermined pools or sets of predetermined game outcomes. In this embodiment, the central server or controller 56 receives the game outcome request and independently selects a predetermined game outcome from a set or pool of game outcomes. The central server or controller 56 flags or marks the selected game outcome as used. Once a game outcome is flagged as used, it is prevented from further selection from the set or pool and cannot be selected by the central controller or server 56 upon another wager. The provided game outcome can include a primary game outcome, a secondary game outcome, primary and secondary game outcomes, or a series of game outcomes such a free games.

The central server or controller 56 communicates the generated or selected game outcome to the initiated gaming device 10. Gaming device 10 receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller 56 and communicated to the initiated gaming device to be presented or displayed to the player. Central production or control can assist a gaming establishment or other entity in maintaining appropriate records, controlling gaming, reducing and/or preventing cheating or electronic or other errors, reducing or eliminating win-loss volatility and the like.

In another embodiment, one or more of the gaming devices of the present invention are in communication with a central server or controller 56 for monitoring purposes only. That is, each individual gaming device 10 randomly generates the game outcomes to be provided to the player and the central server or controller 56 monitors the activities and events occurring on the plurality of gaming devices. In one embodiment, the gaming network includes a real-time or an on-line accounting and gaming information system operably coupled to the central server or controller. The accounting and gaming information system of this embodiment includes a player database for storing player profiles, a player tracking module for tracking players and a credit system for providing automated casino transactions.

A plurality of the gaming devices of the present invention are capable of being connected to a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system of the present invention may be substantially identical to the LAN gaming system described above, although the number of gaming devices in each system may vary relative to each other.

In another embodiment, the data network is an internet or intranet. In this embodiment, the operation of gaming device 10 can be viewed at the gaming device with at least one internet browser. In this embodiment, operation of gaming device 10 and accumulation of credits may be accomplished with only a connection to the central server or controller 56 (the internet/intranet server or webserver) through a conventional phone or other data transmission line, digital signal line (DSL), T-1 line, coaxial cable, fiber optic cable, wireless gateway or other suitable connection. In this embodiment, players may access an internet game page from any location where an internet connection and computer, or other internet facilitator are available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications according to the present invention, particularly if such communications are encrypted. Higher data transmission speeds may be useful for enhancing the sophistication and response of the display and interaction with the player.

In another embodiment, a plurality of gaming devices 10 at one or more gaming sites may be networked to a central server 56 in a progressive configuration, as known in the art, wherein a portion of each wager to initiate a base or primary game may be allocated to bonus or secondary event awards. In one embodiment, a host site computer is coupled to a plurality of the central servers 56 at a variety of mutually remote gaming sites for providing a multi-site linked progressive automated gaming system. In one embodiment, a host site computer may serve gaming devices distributed throughout a number of properties at different geographical locations including, for example, different locations within a city or different cities within a state.

In one embodiment, the host site computer is maintained for the overall operation and control of the system. In this embodiment, a host site computer oversees the entire progressive gaming system and is the master for computing all progressive jackpots. All participating gaming sites report to, and receive information from, the host site computer. Each central server computer 56 is responsible for all data communication between gaming device 10 hardware and software and the host site computer.

Free Spin (Deal) Game With Symbol (Card) Elimination

Figure 3:
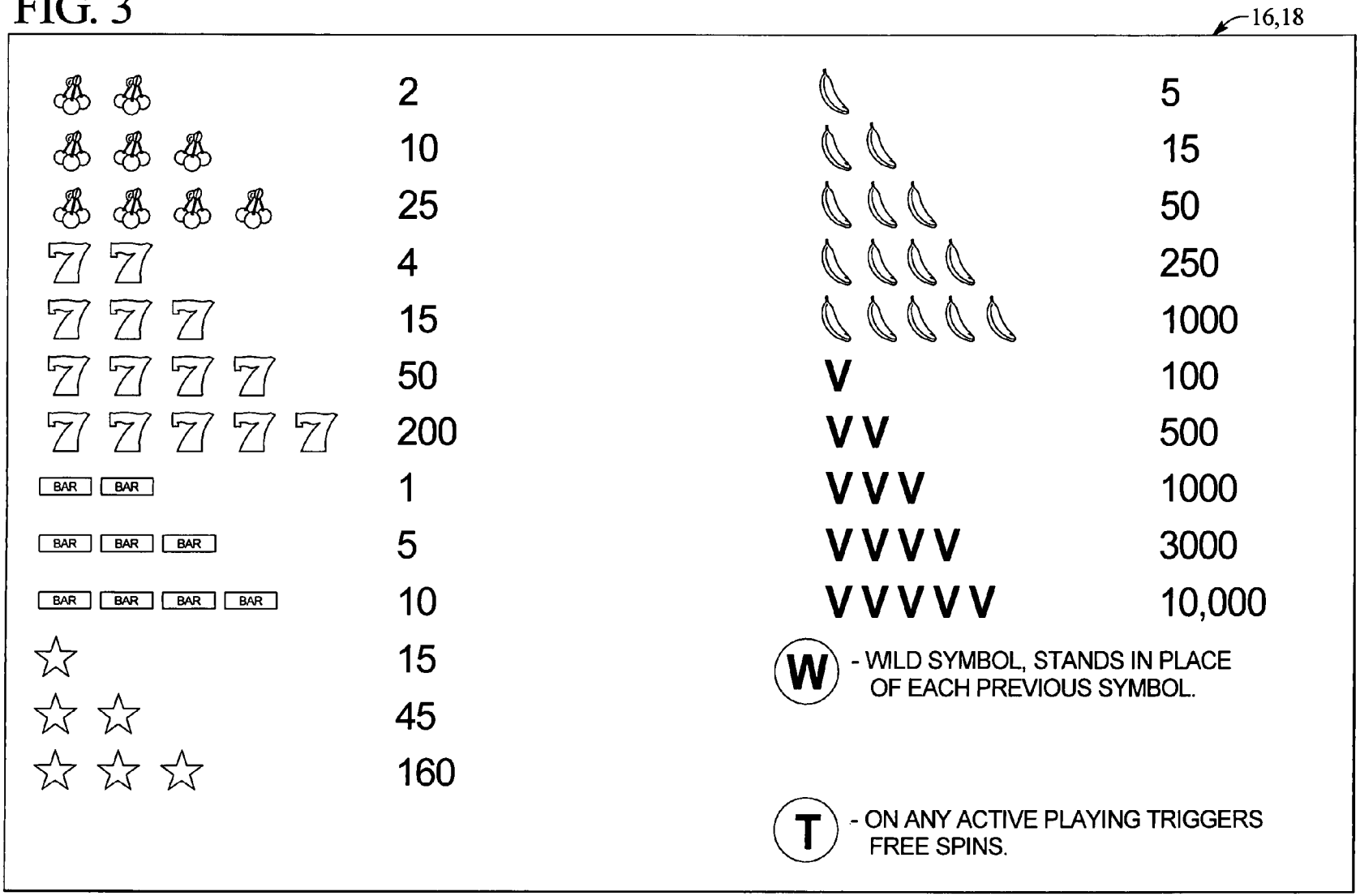
FIG. 3 is an elevation view of one of the display devices of the gaming machine showing one example of a paytable used in connection with the free spin game of the present invention.

Referring now to FIG. 3, one of the display devices 16 or 18 displays one embodiment of a paytable of the present invention. The paytable sets forth winning symbols and winning symbol combinations as well as the number of credits paid to the player for achieving such symbols or combinations. The amount of credits paid corresponds to a likelihood that a particular symbol or symbol combination will appear on the reels 54. For example, two bars as illustrated pays one credit, while a single "V" symbol pays 100 credits. The "V" symbol is accordingly less likely to appear on reels 54 than is the bar symbol.

The paytable illustrates that certain symbols, such as the star, the banana, and the "V" symbols provide a payout for a single appearance of the symbol on the leftmost reel. The winning combinations in general begin from the left side of the reels and extend incrementally towards the right side of the reels. This feature is common among gaming machines and is important to the present invention in one embodiment illustrated below. The symbols alternatively appear at any desired location along the reels.

In one embodiment, a designated symbol or symbol combination triggers the wild symbol and free spin operation of the present invention. In the illustrated paytable, the symbol "T" appearing on an active payline triggers the free spin bonus. Alternatively, the triggering symbol need not appear on an active payline. Further, the triggering of the free spin game could have different or additional requirements, such as requiring: (i) a player's wager or a component thereof to be at a certain level such as max bet; (ii) that the player have played at least a certain number of games; (iii) have wagered a certain amount; (iv) have lost a certain amount. This could alternatively or additionally be based on other requirements such as a player's account such as in relation to a player tracking card. The winning symbols and symbol combinations, as well as the illustrated credit amounts, are used below in the following examples that highlight the features and advantages of the present invention.

Gaming device 10 provides a number of at least two free spins to the player. The number of spins provided can depend on different events, such as: (i) being predetermined, (ii) being randomly determined; (iii) being dependent upon the number of lines played; (iv) being dependent upon the bet per line; (v) being dependent upon the total bet; (vi) being dependent upon a base game outcome; or (vii) any combination thereof.

FIG. 4 illustrates a separate screen of one of the display devices 16 or 18 that illustrates a paytable used in the free spins sequence of the present invention and explains various features of the free spin sequence. FIG. 4 illustrates that the free spin includes six symbols A, B, C, D, F and G. The paytable also indicates that the free spin sequence includes a wild symbol W, which when generated represents or can function as any of the symbols A, B, C, D, F and G that are being used at the start of the game. The paytable also illustrates that the free spin sequence includes at least one execution symbol EX. Execution symbol EX increments a symbol removal meter 70 discussed below with regard to FIG. 7. As discussed herein, when the meter 70 reaches a particular point, one of the symbols A, B, C, D, F or G is removed from the set of available symbols to be subsequently generated, thereby increasing the player's odds of obtaining a winning combination of the remaining symbols in the free spin sequence.

The paytable of FIG. 4 also shows the pays or payouts for various combinations of symbols A, B, C, D, F and G. In particular, the paytable shows that the player is paid two hundred credits for achieving the same five of the A, B, C, D, F or G symbols on a payline that has been active during the previous base game spin. In an alternative embodiment (shown in parentheses), the five symbols can alternatively appear in a scatter arrangement on reels 54*a* to 54*e*. The player receives thirty credits for the generation of four of the same A, B, C, D, F or G symbols on active payline (scatter in an alternative embodiment). Furthermore, the player receives five credits if gaming device 10 generates the same three of the A, B, C, D, F or G symbols on an active payline (alternatively in a scatter arrangement). Also, the player receives two credits for achieving the same two of the A, B, C, D, F or G symbols on an active payline (alternatively in a scatter arrangement).

The paytable of FIG. 4 also shows three different embodiments for the symbol elimination free spin sequence of the present invention. In a commercial version, the screen of FIG. 4 would only show the embodiment that is actually employed in gaming device 10. For ease of illustration, the three different embodiments are each shown in FIG. 4. In an alternative embodiment, each of the three embodiments could be employed in a single gaming device 10, wherein gaming device 10 selects one of the elimination sequences when the player enters the bonus spin sequence of the present invention.

In the first elimination embodiment, gaming device 10 eliminates one of the symbols A, B, C, D, F or G from the symbol set when the free spin sequence generates the execution symbol EX a preset number of times, which is three in this example. By eliminating one of the symbols from the free spin set and causing the remaining symbols to have a higher probability of occurrence, gaming device 10 increases the chances of the player achieving the winning symbol combinations using the remaining symbols shown in the paytable. In one alternative, the eliminated symbols can be replaced with the other remaining symbols which also increases the occurrence of such remaining symbols. As discussed above, a wild symbol W in one embodiment can also replace the eliminated symbol. The wild symbol would function as one of the other remaining symbols. The wild symbol would not function as the eliminated symbol in the preferred embodiment. The wild symbol which replaces the symbol eliminated in the free spin sequence increases the player's chances of achieving one or more winning combinations (which do not include the eliminated symbol) in the free spin sequence.

In the second and third elimination embodiments, one of the symbols of the set is replaced or eliminated when the player obtains a preset number of execution symbols such as three symbols. In one alternative embodiment, the symbol is replaced with a wild symbol that can function as or represent each of the remaining symbols of the set. In another embodiment, the replaced symbol is replaced with one of the remaining symbols. This increases player's chances of generating the winning combinations for the remaining symbols and in particular the chances of obtain winning combinations with a greater number of symbols which provide greater awards.

In the first embodiment, the overall number of reel stop positions is reduced when one of the symbols is eliminated from the set. In the second and third embodiments, the overall number of reel stops stays the same; however, one of the symbols is replaced with a wild symbol or one of the remaining symbols of the set. The reel stops of the replaced symbol will therefore each contain the wild symbol or a remaining symbol.

In one embodiment, an execution symbol can not be eliminated or replaced. In other embodiments, one or more execution symbols can be eliminated or replaced.

In one embodiment, the particular symbol removed or eliminated is chosen randomly. In one embodiment, each of the symbols A, B, C, D, F or G is equally likely to be chosen first, second, third, etc., to be eliminated. The next time the player accumulates the executor symbol EX the preset number of times, one of the remaining symbols is again chosen randomly to be eliminated. In an alternative embodiment, the symbols are eliminated according to a predetermined order. For example, the A symbol could be eliminated first, followed by the B symbol, the C symbol, etc.

In the symbol replacement embodiments, the symbol to be replaced can be generated randomly or selected via a predetermined order as discussed above in the symbol elimination embodiment. Further, when the replaced symbol is replaced with a remaining one of the symbols, the symbol that is selected to replace the replaced symbol is selected randomly or according to a predetermined order.

Referring now to FIG. 5, an alternative paytable is shown on one of the display devices 16 and 18 for a poker game embodiment, which includes a free deal sequence in which hands of cards are dealt repeatedly and sequentially without requiring the player to place an additional wager, and wherein the player receives credits according to the illustrated paytable. The paytable of FIG. 5 differs from the paytable of FIG. 4 not only in the base game that is played but also in the fact that in the slot game, a separate paytable is provided for the free spin sequence, while in the free deal sequence of the poker game, the same paytable and same paying combinations are used both in the base game and in the free deal sequence. Furthermore, the symbols used in the base game and free deal sequence are the same. In a slot embodiment alternative to the one shown above in FIGS. 3 and 4, the present invention alternatively uses a single set of symbols and paytable in both the base and free spin sequences. Thus, the present invention contemplates having completely separate sets of symbols in the base and free spin or deal sequences, using some of the symbols or cards in both base and free generation sequences, or using the same set of symbols or cards in both the base and free spin or free deal sequences.

The paytable shown in FIG. 5 illustrates that for the base poker game and the free deal sequence: a royal flush pays three hundred credits; five-of-a-kind pays one hundred credits; a straight flush pays fifty credits; four-of-a-kind pays twenty-five credits; a flush pays fifteen credits; a full house pays ten credits; three-of-a-kind pays six credits; a straight pays four credits; two pairs pays three credits; and jacks or better pays two credits.

FIG. 5 illustrates that a triggering T symbol in combination with jacks or better triggers the free deal sequence of the present invention. In an alternative embodiment, only the triggering T symbol is required. In a further alternative embodiment, any standard card or combination of playing cards triggers the free deal sequence and a separate trigger symbol is not used. Similarly, a base game slot machine symbol or combination thereof may be used to trigger the free spin slot sequence as opposed to a dedicated trigger symbol.

FIG. 5 also provides a description of the free deal sequence. Here, the Jokers Wild card is activated and represents each remaining face card in the poker deck. The illustrated embodiment of the free deal sequence operates differently than the free spin sequence of the slot game because a dedicated execution symbol is not provided in the free deal sequence. That is, as illustrated, the appearance of an ace after a free deal generation increments the symbol removal or replacement meter.

The free deal sequence like the free spin sequence includes multiple different embodiments. In one embodiment, an accumulation of a preset number, e.g., three, aces causes gaming device 10 to eliminate one of the remaining card denominations from the deck. In a second embodiment, the accumulation of, e.g., three aces causes one of the remaining card denominations to be replaced with a Joker card. In a further alternative embodiment, the accumulation of three aces causes a remaining one of the cards to be replaced with another one of the remaining cards.

In the third embodiment, one of the cards, e.g., the Two of Hearts, Diamonds, Spades or Clubs, is replaced with another denomination, such as an extra set of Jacks. In such a case, the deck would then include a total of eight Jacks. It is believed that this embodiment as well as the Jokers Wild replacement embodiment will significantly increase the player's chances of obtaining higher paying card combinations, such as four-of-a-kind and a flush. As before, the gaming device 10 can be set so that the number of accumulated cards needed to eliminate or replace a card is at any suitable level and is not limited to accumulating the illustrated three cards.

As discussed above with the free spin sequences, the order in which card denominations are eliminated from the deck can be randomly determined or determined via a preset order. Further, in the third embodiment, the card that replaces the replaced card can be randomly determined or determined via a preset order.

Figure 6:
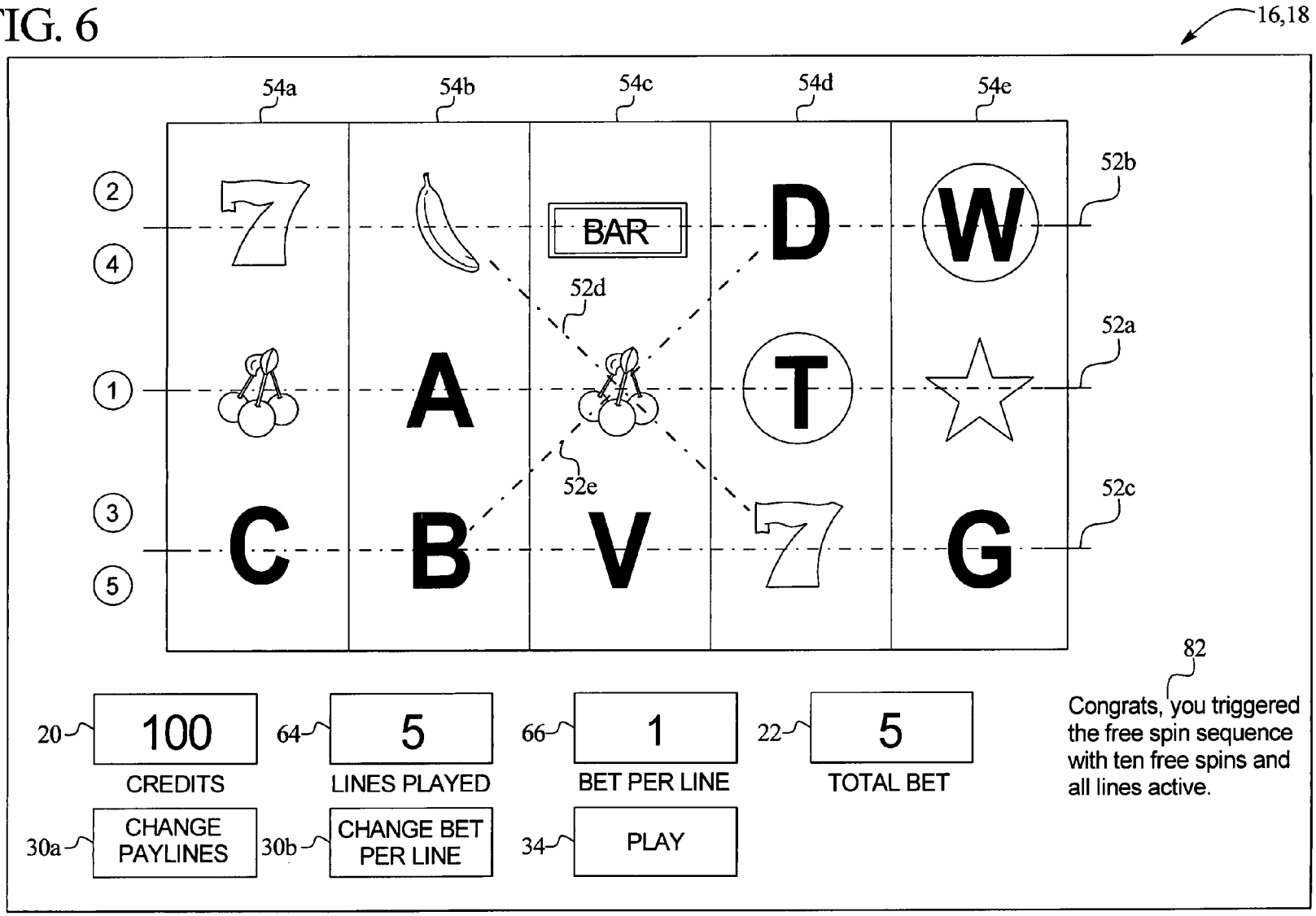
FIGS. 6, 7, 8, 9, 10 and 11 illustrate an example of the free spin sequence operating with the base game of slot.

Referring now to FIGS. 6 to 11, one example of the slot machine free spin sequence of the present invention is illustrated. FIG. 6 shows one of the display screens 16 or 18 displaying the reels, paylines, indicators and selectors described above are shown on one of the display devices 16 or 18, namely, five reels 54*a* to 54*e* and five paylines 52*a* to 52*e*. Display device 16 or 18 shows the total credit display 20, lines played display 64, bet per line display 66, total bet display 22, change paylines input 30*a*, change bet per line input 30*b* and play button 34. Free spins meter 68 is also shown in FIGS. 7 to 11.

FIG. 6 illustrates that the player playing the base game has a current total of one hundred credits and has just generated the free spin slot machine bonus of the present invention by generating the triggering "T" symbol on payline 52*a*. The player is provided ten free spins as indicated by meter 68 shown in FIG. 7. Gaming device 10 arrives at ten free spins via any of the methods discussed above. In one implementation, the player is provided more free spins if a single triggering symbol "T" lands on multiple active paylines, such as on paylines 52*c* and 52*e*, or if two or more triggering symbols "T" are generated each on single paylines.

Gaming device 10 has accordingly provided an audio, visual or audiovisual message 82 informing the player that gaming device 10 has triggered the free spin sequence with ten free spins and all lines active. In an embodiment, the player receives more free spins by obtaining multiple triggering T symbols on one or more active paylines.

Figure 7:
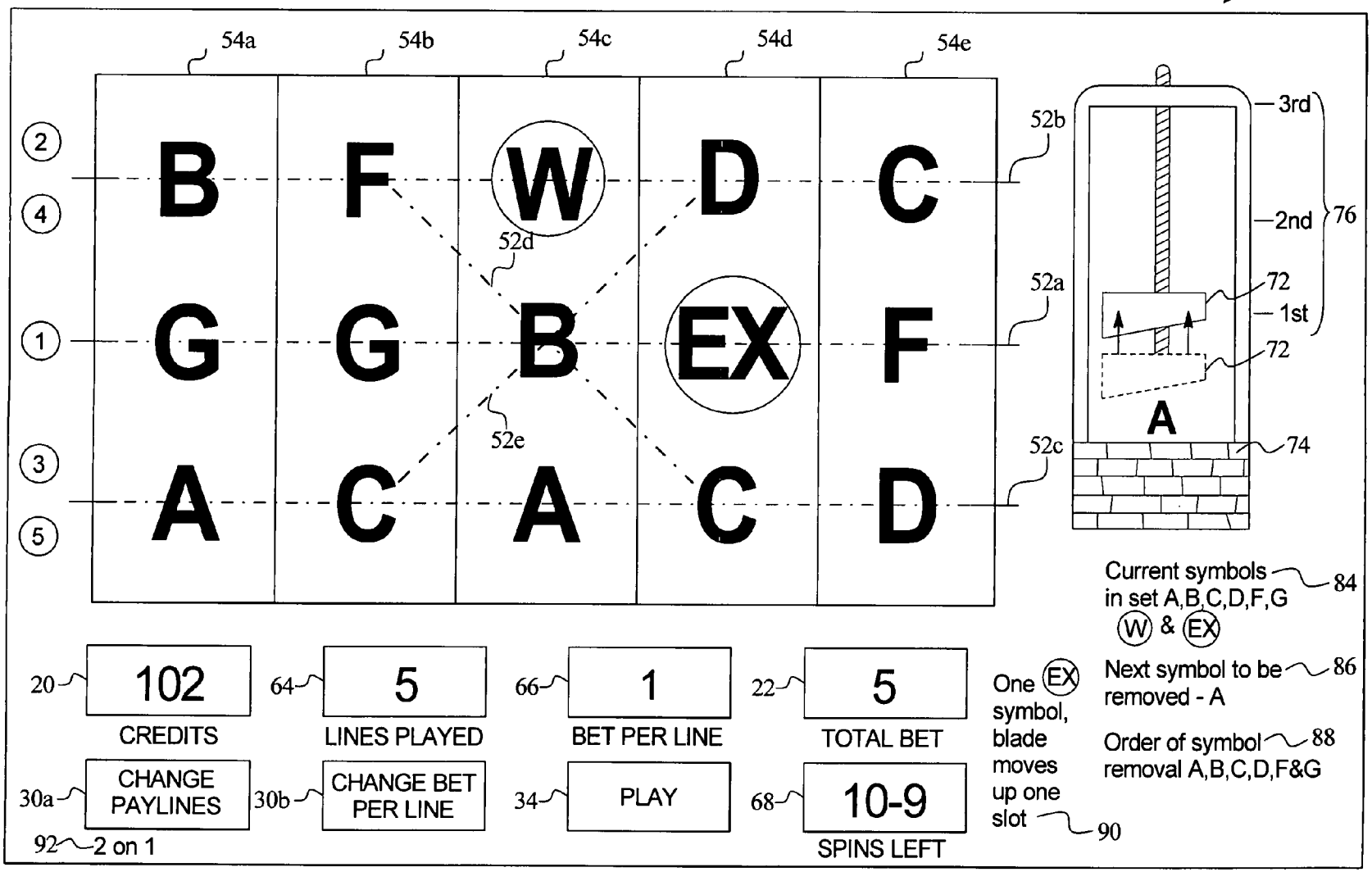

In FIG. 7, the spins remaining meter 68 is illustrated in addition to the symbol elimination or replacement display 70. In an embodiment, display 70 follows a theme of gaming device 10. Here, display or meter 70 includes a guillotine having a blade 72 and a basket 74. The blade is sequentially raised to first, second and third levels 76.

FIG. 7 also illustrates the symbols currently used in the free spin set via audio, visual or audiovisual message 84. In particular, all symbols A, B, C, D, F and G as well as the wild and executor symbols EX can be generated randomly on reels 54*a* to 54*e*. The illustrated embodiment includes a predetermined order of symbol removal, as indicated by message 88. In particular, the symbols are removed in alphabetical order, namely, A, B, C, D, F and G. Alternatively, the symbols are removed in any desired preset order or in a randomly generated order. A message 86 is also provided showing that the first or next symbol that is removed is the symbol A. Accordingly, symbol A appears beneath the blade 72 of the guillotine display 70.

The free spin sequence in one embodiment is auto-generating and has generated a first free spin outcome shown in FIG. 7. Accordingly, spins remaining meter 68 shows a transition from the original ten provided free spins to nine free spins. In an alternative embodiment, the free spins are activated upon an input by the player. Gaming device 10 provides a message 90 indicating that one executor symbol EX has been generated on an active payline (all five paylines active in this example) and causes blade 72 of guillotine 70 to move up one slot. Display 70 accordingly shows the original position of blade 72 shown in phantom and the new position of blade 72 shown in solid. Gaming device 10 also shows a message 92 indicating that the player has won two credits on payline 1 (for receiving the "G", "G" combination on payline 52*a*). Accordingly, the player's credits increase from one hundred to one hundred two as shown in credit display 20.

Figure 8:
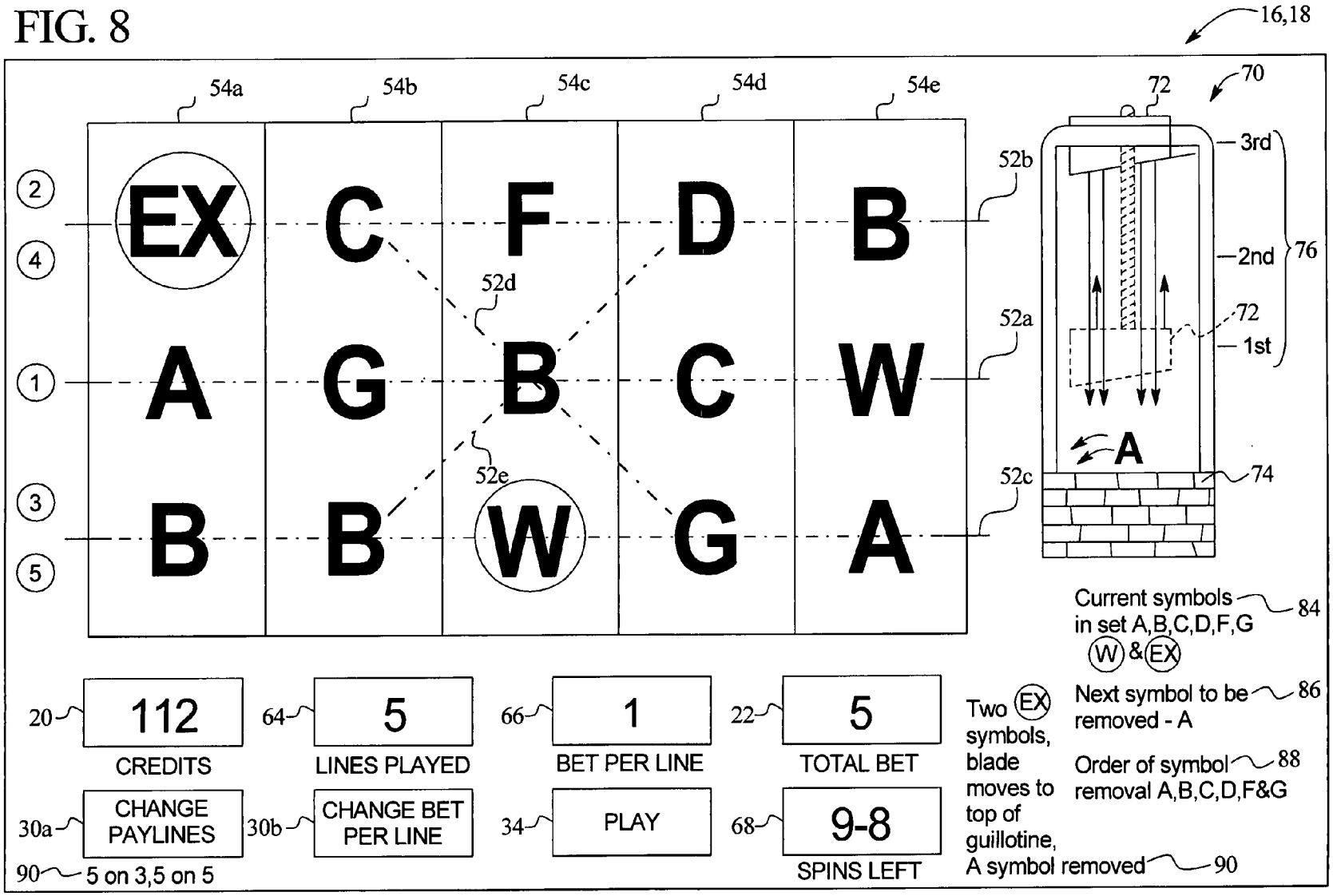

Referring now to FIG. 8, gaming device 10 auto-generates a second free spin, as shown in spins remaining display 68. Message 90 indicates that two executor symbols EX have been generated. As seen, an executor EX symbol appears on each of paylines 52*b* and 52*d*. The two executor symbols move blade 72 to the top of guillotine 70. Blade 72 then falls and chops symbol A into basket 74. As seen by first, second and third positions 76, blade 72 moved from the first position 76 to the third position 76, which is the uppermost position. In an alternative embodiment, a different number of positions is used in meter 70. In a further alternative embodiment, the meter 70 is not employed and one of the symbols of the free spin sequence is eliminated upon each generation of one of the executor symbols.

Message 92 indicates that the free spin outcome in FIG. 8 has generated five credits for the "B, B, B" combination appearing on payline 3 and five credits for the same combination appearing along payline 5. The wild symbol generated on reel 54*c* increases the "B, B" win on payline 3 to a three symbol payout. Accordingly, the player's total credits increases to one hundred twelve as seen in credit display 20.

Figure 9:
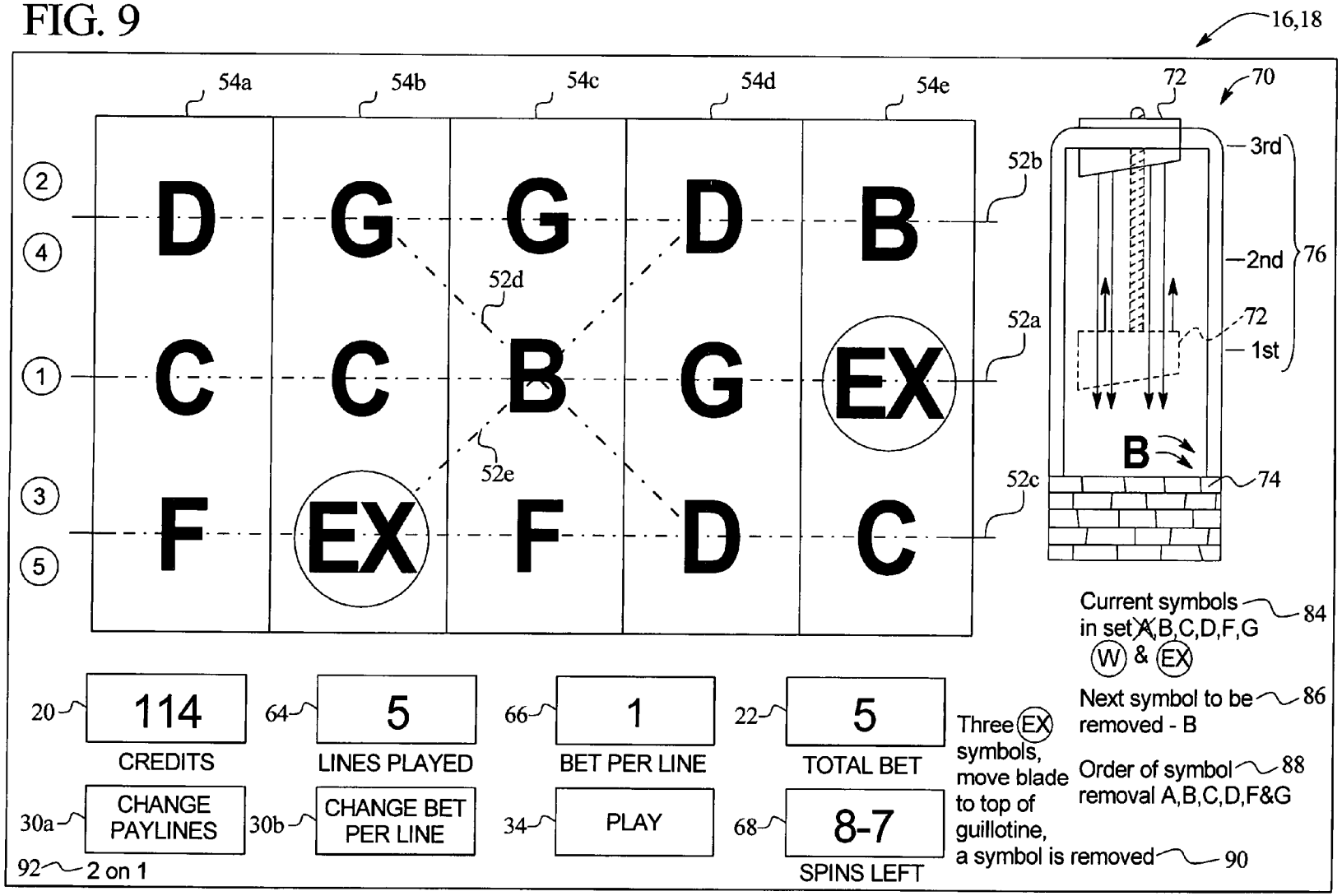

Referring now to FIG. 9, the symbol A has been eliminated and can no longer be generated on reels 54*a* to 54*e*. In the alternative embodiments described above, the symbol A is either replaced with the wild symbol or with one of the remaining symbols B, C, D, F and G. Message 84 shows that the symbol A has been crossed out, removed or replaced. Message 86 indicates that the next symbol to be removed is now the symbol B. Accordingly, symbol B appears below blade 72 in guillotine or meter 70.

For the third spin of FIG. 9, message 90 indicates that the free spin has generated three executor symbols, which has moved the blade to the top or third position on guillotine 70. Blade 72 is accordingly shown in phantom from its original position below the first position and in solid in the top position or third position 76. Arrows are also shown to indicate that blade 72 falls to cut or chop symbol B into basket 74. Message 92 also indicates that two credits are provided because gaming device 10 generated the "C, C" combination on payline 52*a*. The player's total credits accordingly increase to one hundred fourteen as seen in credit display 120. Also, the player's remaining spins change from eight to seven as seen in spins remaining display 68.

Figure 10:
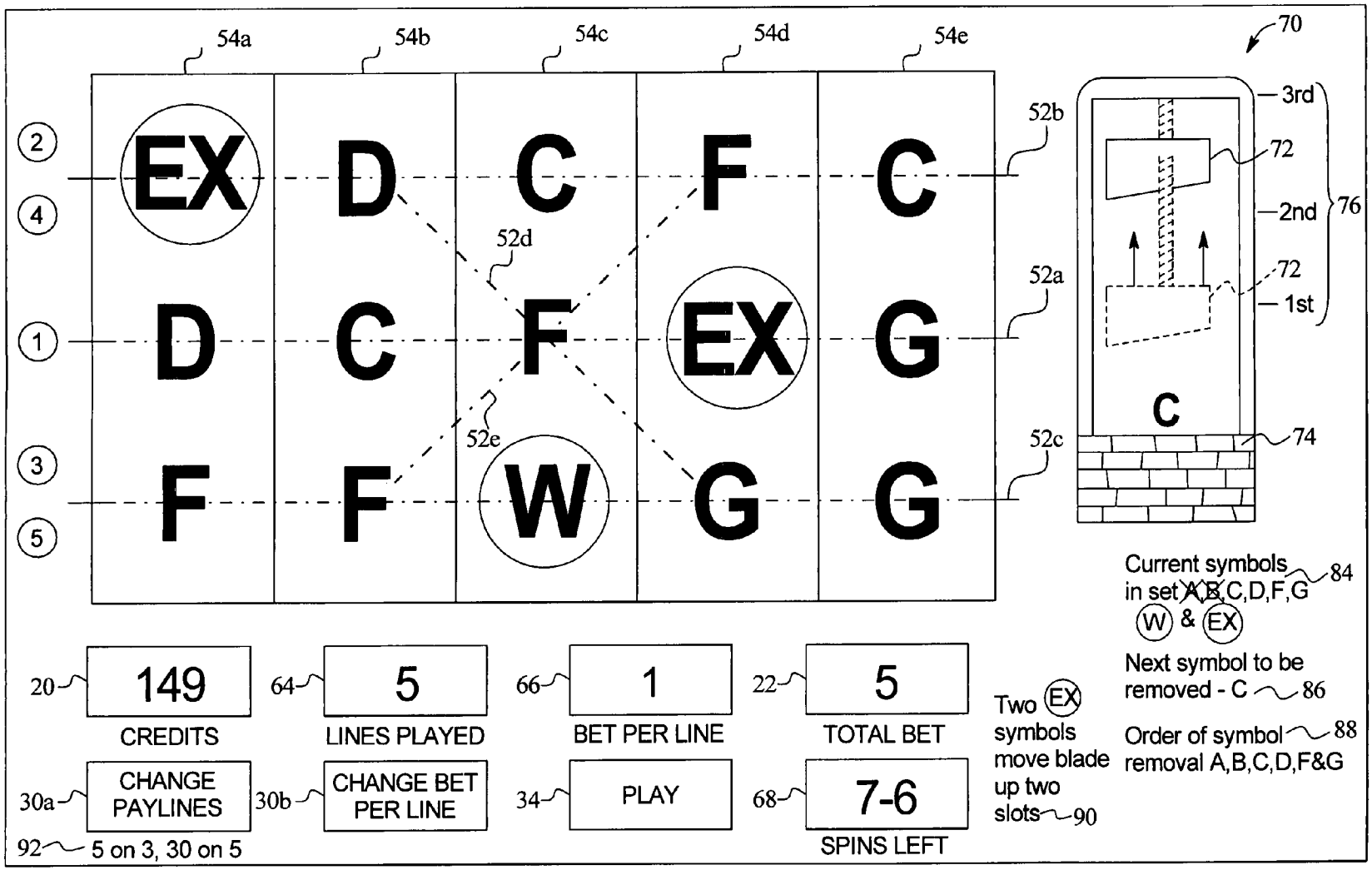

Referring now to FIG. 10, an outcome of the fourth free spin is shown. Message 84 shows that the A and B symbols are crossed out, removed or replaced. Accordingly, those symbols are no longer available to be generated on reels 54*a* to 54*e*. It should be appreciated that by eliminating or replacing symbols, the chances of receiving a larger combination of the remaining symbols C, D, F and G along paylines 52*a* to 52*e* or in a scatter arrangement increases.

Message 90 indicates that two executor symbols have been generated and have moved blade 72 up two spots to the second position 76. Guillotine 70 accordingly shows the blade 72, which is reset after each elimination or replacement, displayed in phantom in the original or reset position. Blade 72 is shown in solid at the incremented or metered position adjacent to the second position 76. Message 86 indicates that the current or next symbol that will be removed is symbol C. Accordingly, symbol C is shown above basket 74 of guillotine 70.

Spins remaining meter 68 shows that the remaining spins have changed from seven to six. Message 92 indicates that the player has won five credits on payline 52*c* for the "F, F, W" combination. Also, the player has won thirty credits for receiving the "F, F, F, F" combination on payline 52*e*. Such larger combinations of symbols have an increased likelihood of occurring in the current free spins because symbols A and B are not available to be generated. The player's total credits accordingly increase to one hundred forty-nine as seen in credit display 20.

Figure 11:
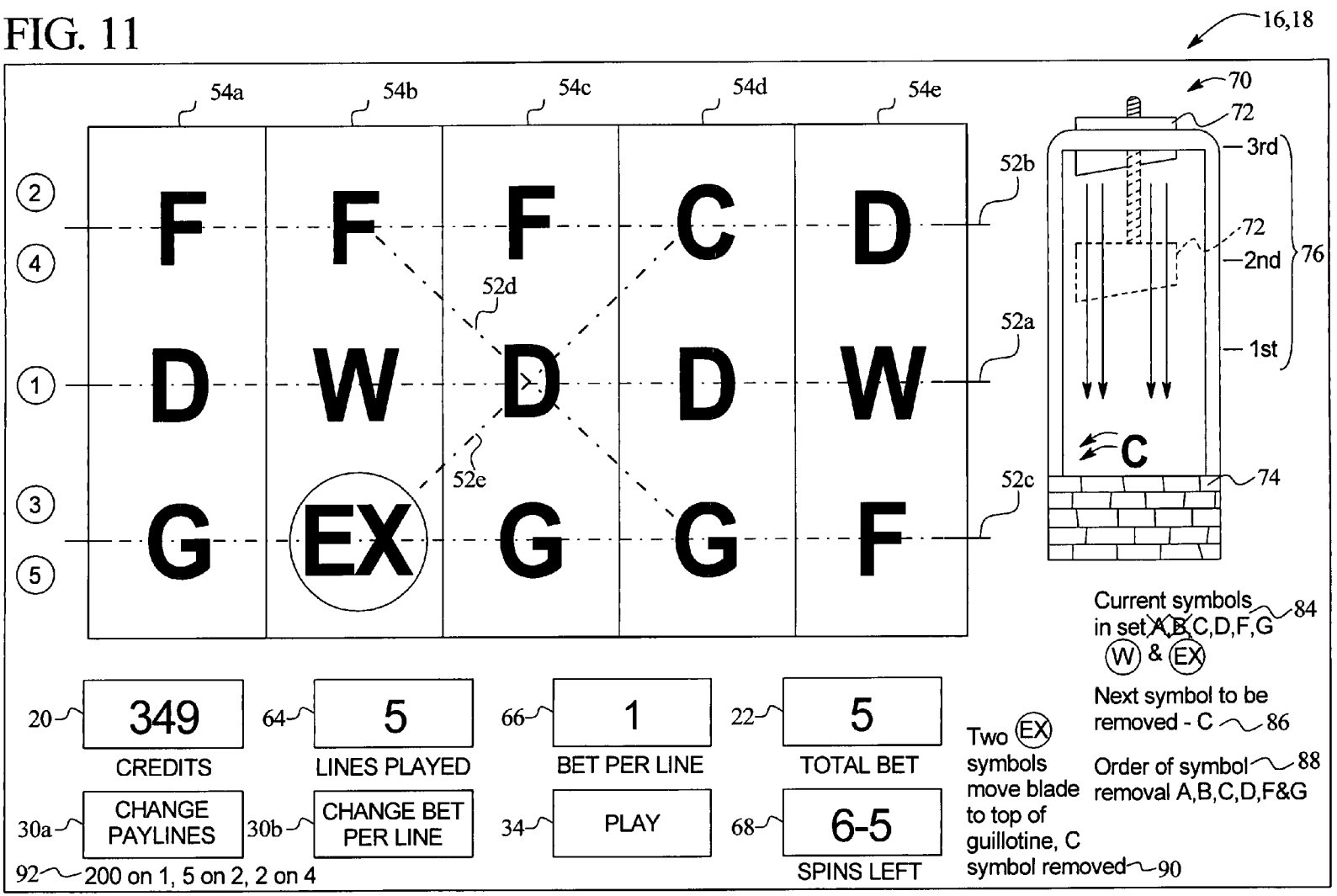

Referring now to FIG. 11, the outcome of the fifth free spin of the free spin sequence is illustrated. Message 90 shows that two executor symbols have been generated. In particular, a single executor symbol appearing on reel 54*b* is generated for both paylines 52*c* and 52*e*. Guillotine 70 shows that blade 72 is initially at the second position 76 and only needs to move to the third position 76 before falling to eliminate or replace the C symbol into basket 74. As discussed, however, gaming device 10 has generated two executor symbols. In one embodiment, gaming device 10 does not provide an additional benefit when an extra executor symbol is generated, i.e., more symbols than are needed to increment meter 70 to the final position. In an alternative embodiment, blade 72 is reset to the first position 76 in the next free spin as opposed to resetting blade 72 to the original position. In a further alternative embodiment, a separate bonus is provided to the player, such as a number of credits or a credit multiplier.

In FIG. 11, guillotine 70 shows blade 72 in solid at the uppermost position 76 and provides arrows indicating that the blade moves to cut or chop symbol C into basket 74. The next symbol to be removed as shown by message 86 is symbol C. Further, the next free spin will show the C symbol crossed out. Accordingly, in the next free spin, only symbols D, F and G as well as the wild symbol W and executor symbol EX are available to be generated. The player's chances of winning a high value award will increase again and can potentially increase further if one or more of the symbols D, F and G is eliminated. Indeed, it is possible that only one paying symbol can remain besides the wild W and executor symbols.

Spins remaining display shows that the player has five remaining spins after the spin of FIG. 11. Message 92 indicates that the player wins two hundred credits for achieving five D symbols (using two wild symbols W) on payline 52*a*, five credits for achieving three F symbols on payline 52*b* and two credits for achieving two F symbols on payline 52*d*. The player's total credits increase accordingly to three hundred fifty-six as shown in credit display 20.

Referring now to FIGS. 12 to 14, one embodiment of the free deal sequence used in combination with the base game of poker is illustrated. In FIG. 12, audio, visual or audiovisual message 82 is provided to show that the generation of the transfer symbol T in combination with a pair of kings at positions 94*a* and 94*c* has met the jacks or better requirement for triggering the free deal sequence. Accordingly, the free deal sequence is auto-generated or generated upon a player input in an alternative embodiment. The player also receives two credits for obtaining a single of jacks or better at positions 94 and 96. The player's credits increase accordingly from one hundred to one hundred-two as shown in credit display 20. The two credits are also shown in win display 80.

Referring now to FIG. 13, the outcome of the first free deal of the free deal sequence is illustrated. Ten free spins are provided initially as seen in meter 68 according to any of the factors or determiners described above. Guillotine 70, blade 72, and basket 74 discussed above are used again in the free deal sequence. Alternatively, a different card elimination meter is used. Further alternatively, a meter 70 is not employed and one of the card denominations is eliminated upon receiving any of the elimination symbols. As discussed above, in the illustrated embodiment the elimination symbols are the Ace cards. Alternatively, a separate and dedicated executor card, such as the executor card EX is used here in the poker embodiment.

Message 90 of FIG. 13 indicates that the player has received two Ace cards, namely, at positions 94*a* and 94*d*. Blade 72 of guillotine 70 therefore moves from the original position to the second position 76. Guillotine 70 and message 86 indicate that the first or next symbol to be removed or replaced is all four of the Two cards. That is, when the card denomination Two is removed or replaced, all four suits of Two cards are eliminated. Message 84 indicates that the current cards in the deck are the Two through Ace denominations as well as one or more Joker cards. Message 88 also shows the order of removal to be in ascending order of Two, Three, Four, Five, Six, Seven, Eight, Nine and Ten. Alternatively, a different preset order is used. Further alternatively, cards are eliminated or replaced randomly.

In FIG. 13, win meter 80 shows that the player receives three credits for obtaining the two pair combination, Aces and Fives. The player's total credits therefore increase to one hundred five as seen in credit display 20. The player's remaining spins change from ten to nine as seen in spins remaining display 68.

FIG. 14 illustrates the outcome of the second free deal of the free deal sequence. Message 90 indicates that a single Ace has been generated, which moves the blade 72 of guillotine 70 from the second position 76 to the third position 76 as illustrated. Because blade 72 has reached the final or third position, the blade drops and cuts or removes or replaces the Two cards from the deck used in the free deal sequence. Accordingly, the current cards in the deck as indicated by message 84 changes from Two to Ace to Three to Ace (and the Jokers Wild). The next card to be removed is the Three denomination as seen in message 86 and in accordance with the order of removal shown in message 88.

The player receives four credits as seen in win display 80 for receiving the straight (using Jokers Wild symbol in position 94*e*). The player's total credits therefore increase to one hundred nine as seen in credit display 20. The spins remaining display shows the remaining spins changing from nine to eight.

In subsequent free deals, the Two card is no longer generated. Therefore, the odds of obtaining multiple ones of any remaining cards are increased. As the player continues to eliminate cards from the deck, the player's chances of obtaining a higher combination of any of the remaining cards further increases. Again, as with the free spin sequence, if the player generates more position moves than are needed to bring blade 72 to the top or third position 76, the blade can begin anew at the first or second position on guillotine 70 in the next free deal. Otherwise, the blade can return to the original position without providing the player an additional benefit. Further alternatively, the player is provided a separate bonus, such as a number of credits or a multiplier for receiving the additional and unneeded executor or Ace card.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A gaming device comprising:

at least one input device;

at least one display device;

at least one processor; and at least one memory device which stores a plurality of instructions that, when executed by the at least one processor, cause the at least one processor to operate with the at least one display device and the at least one input device to:

(a) display a base game upon a wager by a player, said base game including a plurality of reels and a symbol set including a plurality of symbols on the reels; and (b) upon an occurrence of a free spin sequence triggering event associated with the base game, display a free spin sequence, said free spin sequence including:

(i) a plurality of free spins of the reels, and (ii) a symbol elimination triggering event which can occur in one or more of said free spins of the free spin sequence, and which causes at least one of the symbols of the symbol set to be an eliminated symbol which is prevented from occurring in each subsequent free spin of the free spin sequence to increase a likelihood of achieving at least one combination of any remaining symbols of the symbol set in said subsequent free spins.

2. The gaming device of claim 1, wherein the eliminated symbol is replaced by another symbol of the symbol set for said subsequent free spins.

3. The gaming device of claim 1, wherein the eliminated symbol is replaced by a wild symbol.

4. The gaming device of claim 1, wherein the eliminated symbol is replaced by a remaining one of said symbols in said symbol set.

5. The gaming device of claim 1, wherein the symbols on the reels in the base game are the symbols on the reels in the free spin sequence.

6. The gaming device of claim 1, wherein the free spin sequence triggering event includes an occurrence of a designated triggering symbol or designated triggering symbol combination.

7. The gaming device of claim 1, wherein the symbol elimination triggering event includes an occurrence of at least one particular symbol on the reels in one of the free spins.

8. The gaming device of claim 1, wherein the symbol elimination triggering event is associated with a count, the count incremented upon an occurrence of at least one particular symbol on the reels in the free spins, the symbol elimination triggering event occurring upon the count reaching a designated level.

9. The gaming device of claim 8, wherein the eliminated symbol is a first eliminated symbol, and wherein, upon the count again reaching the designated level, the plurality of instructions, when executed by the at least one processor, cause the at least one processor to cause at least one of the remaining symbols of the symbol set to be a second eliminated symbol, the second eliminated symbol prevented from occurring in at least one subsequent free spin to further increase the likelihood of achieving at least one combination of any remaining symbols of the symbol set in said subsequent free spin.

10. The gaming device of claim 8, in which upon a single free spin of the reels the count is incremented multiple times when the particular symbol is generated multiple times.

11. The gaming device of claim 1, wherein the eliminated symbol is a first eliminated symbol, and which includes a second eliminated symbol, the second eliminated symbol prevented from occurring in at least one subsequent free spin upon a reoccurrence of the symbol elimination event, the second eliminated symbol further increasing the likelihood of achieving at least one combination of the remaining symbols in said subsequent free spin.

12. The gaming device of claim 1, wherein the number of free spins in the free spin sequence is (i) preset, (ii) based on an outcome of the base game, (iii) determined randomly, (iv) based on an outcome during the free spin sequence, (v) based on a wager made by a player, (vi) based on a component of the wager made by the player, or (vii) any suitable combination thereof.

13. The gaming device of claim 1, which includes a paytable of combinations of the symbols used in the free spin sequence to determine awards based on the combination of symbols generated in the free spins.

14. The gaming device of claim 1, wherein the set of symbols includes a wild symbol that can functions as at least one other of the symbols.

15. The gaming device of claim 1, wherein the reels are video reels.

16. A gaming device comprising:

at least one input device;

at least one display device;

at least one processor; and at least one memory device which stores a plurality of instructions that, when executed by the at least one processor, cause the at least one processor to operate with the at least one display device and the at least one input device to:

(a) display a plurality of reels, said reels including a plurality of base game symbols, wherein in each play of a base game a plurality of the symbols are generated by the reels and the symbols are evaluated in the said play of base game for one or more payouts; and (b) display a free spin sequence in which the reels are spun a plurality of times after a play of the base game, the free spin sequence including:

(i) a set of free spin symbols, wherein a plurality of said free spin symbols are generated on the reels and evaluated for one or more payouts in each free spin, and (ii) an event which can occur one or more times in the free spin sequence and which causes at least one of the free spin symbols of the set to be replaced by a wild symbol that functions as one of the remaining symbols of the set for at least one subsequent free spin to increase a likelihood of achieving a payout in said subsequent free spin.

17. The gaming device of claim 16, wherein the base game symbols are different than the free spin symbols.

18. The gaming device of claim 16, wherein the event includes an appearance of at least one particular symbol of the set on the reels.

19. The gaming device of claim 16, wherein the event is associated with a count, the count incremented upon an appearance of at least one particular symbol of the set on the reels, the event occurring upon the count reaching a designated level.

20. The gaming device of claim 19, wherein the replaced symbol is a first replaced symbol, and wherein upon the count again reaching the designated level, the plurality of instructions, when executed by the at least one processor, cause the at least one processor to cause at least one of the remaining free spin symbols of the set to be a second replaced symbol, said second replaced symbol replaced by another wild symbol for at least one subsequent free spin.

21. The gaming device of claim 16, wherein the replaced symbol is a first replaced symbol, and wherein, upon a reoccurrence of the event, the plurality of instructions, when executed by the at least one processor, cause at least one of the remaining free spin symbols of the set to be a second replaced symbol, said second replaced symbol replaced by another wild symbol for at least one subsequent free spin.

22. The gaming device of claim 16, wherein the free spin sequence includes a number of free spins, the number being (i) preset, (ii) based on an outcome of the base game, (iii) determined randomly, (iv) based on an outcome during the free spin sequence, (v) based on a wager made by a player, (vi) based on a component of the wager made by the player, or (vii) any suitable combination thereof.

23. The gaming device of claim 16, wherein upon replacement of one of the free spin symbols from the set, a corresponding paying combination of a paytable can no longer be generated, but wherein a likelihood of generating another one of the paying combinations increases.

24. The gaming device of claim 16, wherein upon replacement of one of the free spin symbols from the set, a likelihood of achieving an increased payout in said at least one subsequent free spin increases.

25. A gaming system comprising:

at least one input device;

at least one display device;

at least one processor; and at least one memory device which stores a plurality of instructions which when executed by the at least one processor cause the at least one processor to operate with the at least one display device and the at least one input device to:

(a) display a base game operable upon a wager by a player, said base game having a plurality of reels and a symbol set including a plurality of symbols on the reels;

(b) after an occurrence of a free spin sequence triggering event associated with the base game, display a free spin sequence which includes a plurality of free spins of the plurality of reels, and for each of said free spins of the free spin sequence:

(i) cause an activation of said plurality of reels to generate a plurality of the symbols on the reels;

(ii) evaluate the plurality of symbols generated on the reels;

(iii) provide any awards associated with any winning combinations of generated symbols on the reels; and (iv) if a symbol elimination triggering event occurs, cause at least one of the symbols of the symbol set to be an eliminated symbol which is prevented from occurring in at least one subsequent free spin, if any, of the free spin sequence to increase a likelihood of achieving at least one combination of the remaining symbols of the symbol set in said at least one subsequent free spin.

26. The gaming device of claim 25, wherein the plurality of instructions when executed by the at least one processor cause the at least one processor to replace the eliminated symbol with another symbol of the symbol set for said at least one subsequent free spin.

27. The gaming device of claim 25, wherein the plurality of instructions when executed by the at least one processor cause the at least one processor to replace the eliminated symbol with a wild symbol for said at least one subsequent free spin.

28. The gaming device of claim 25, wherein the plurality of instructions when executed by the at least one processor cause the at least one processor to replace the eliminated symbol with a remaining one of said symbols in said symbol set.

29. The gaming device of claim 25, wherein the symbols on the reels in the base game are the symbols on the reels in the free spin sequence.

30. The gaming device of claim 25, wherein the symbol elimination triggering event is associated with a count, the count incremented upon an occurrence of at least one particular symbol on the reels in the free spins, the symbol elimination triggering event occurring upon the count reaching a designated level.

31. The gaming device of claim 30, wherein the count is incremented multiple times if the particular symbol is generated multiple times in a single one of said free spins of the reels.

32. A gaming system comprising:

at least one input device;

at least one display device;

at least one processor; and at least one memory device which stores a plurality of instructions which when executed by the at least one processor cause the at least one processor to operate with the at least one display device and the at least one input device to:

(a) display a base game including a plurality of reels including a plurality of base game symbols, (b) for each play of said base game, cause a plurality of the base game symbols to be generated by said plurality of reels and evaluate the generated base game symbols for one or more payouts, (c) after an occurrence of a free spin sequence triggering event, display a free spin sequence including a plurality of free spins of the plurality of reels, said free spin sequence associated with a set of free spin symbols, and (d) for each of said free spins of the free spin sequence:

(i) generate a plurality of the free spins symbols from the set on the plurality of reels, (ii) evaluate the generated free spin symbols, (iii) provide any awards associated with any winning combinations of generated free spin symbols on the reels; and (iv) if there are any free spins remaining, cause at least one of the free spin symbols to be replaced by a wild symbol that functions as one of the remaining symbols of the set for at least one subsequent free spin to increase a likelihood of achieving a payout in said at least one subsequent free spin.

33. The gaming device of claim 32, wherein the base game symbols are different than the free spin symbols.

34. The gaming device of claim 32, wherein the plurality of instructions when executed by the at least one processor cause the at least one processor to cause said at least one of the free spin symbols to be replaced by a wild symbol upon an occurrence of a designated event.

35. The gaming device of claim 34, wherein the designated event is associated with a count, the count incremented upon an appearance of at least one particular symbol of the set on the reels, the designated event occurring upon the count reaching a designated level.

36. The gaming device of claim 32, wherein upon replacement of one of the free spin symbols from the set, a corresponding paying combination of a paytable can no longer be generated, but a likelihood of generating another paying combination increases.

37. The gaming device of claim 32, wherein upon replacement of one of the free spin symbols from the set, a likelihood of achieving an increased payout in said at least one subsequent free spin increases.

38. The gaming device of claim 32, wherein the free spin sequence triggering event is associated with the base game.

* * * * *

UNITED STATES PATENT AND TRADEMARK OFFICE

CERTIFICATE OF CORRECTION

PATENT NO. : 7,749,063 B2
APPLICATION NO. : 10/953818
DATED : July 6, 2010
INVENTOR(S) : Belger et al.

It is certified that error appears in the above-identified patent and that said Letters Patent is hereby corrected as shown below:

In Claim 14, Column 20, Line 64, replace "functions" with --function--.

Signed and Sealed this

Fourteenth Day of September, 2010

David J. Kappos

David J. Kappos
*Director of the United States Patent and Trademark Office*